US005216995A

United States Patent [19]

Hosoda et al.

[11] Patent Number: 5,216,995

[45] Date of Patent: Jun. 8, 1993

[54] EVAPORATIVE FUEL-PURGING CONTROL SYSTEM AND AIR-FUEL RATIO CONTROL SYSTEM ASSOCIATED THEREWITH FOR INTERNAL COMBUSTION ENGINES

[75] Inventors: Fumio Hosoda; Sachito Fujimoto; Masashi Uchiyama; Toshikazu Oketani; Yoshiharu Abe; Kazumi Yamazaki; Teruo Wakashiro; Hideo Moriwaki, all of Wako, Japan

[73] Assignee: Honda Giken Kogyo Kabushiki Kaisha, Tokyo, Japan

[21] Appl. No.: 876,982

[22] Filed: May 1, 1992

[30] Foreign Application Priority Data

May 20, 1991 [JP] Japan ..... 3-143775
Aug. 7, 1991 [JP] Japan ..... 3-222200

[51] Int. Cl.[5] ..... F02M 33/02
[52] U.S. Cl. ..... 123/520; 123/518
[58] Field of Search ..... 123/518, 519, 520, 521, 123/198 D, 494

[56] References Cited

U.S. PATENT DOCUMENTS

| | | | |
|---|---|---|---|
| 4,537,172 | 8/1985 | Kanehara et al. | 123/494 |
| 4,748,959 | 6/1988 | Cook et al. | 123/520 |
| 4,867,126 | 9/1989 | Yonekawa et al. | 123/198 D |
| 4,913,121 | 4/1990 | Shimomura et al. | 123/520 |
| 4,926,825 | 5/1990 | Ohtaka et al. | 123/520 |
| 4,945,885 | 8/1990 | Gonze et al. | 123/520 |
| 5,048,493 | 9/1991 | Orzel et al. | 123/520 |
| 5,060,621 | 10/1991 | Cook et al. | 123/520 |
| 5,085,197 | 2/1992 | Mader et al. | 123/520 |
| 5,111,796 | 5/1992 | Ogita | 123/518 |

FOREIGN PATENT DOCUMENTS

| | | |
|---|---|---|
| 62-131962 | 6/1987 | Japan . |
| 63-111277 | 5/1988 | Japan . |

*Primary Examiner*—E. Rollins Cross
*Assistant Examiner*—Thomas N. Moulis
*Attorney, Agent, or Firm*—Nikaido, Marmelstein, Murray & Oram

[57] ABSTRACT

A mass flowmeter outputs an output value indicative of the flow rate of a gaseous mixture containing evaporative fuel and being purged into the intake system of an internal combustion engine. A calculated value of the flow rate of the mixture is obtained based on a plurality of operating parameters of the engine. The actual flow rate of the mixture and/or the actual flow rate of the evaporative fuel are/is calculated based on the output value from the mass flowmeter and the calculated value based on the engine operating parameters. The concentration of the evaporative fuel is calculated from the calculated actual flow rates of the evaporative fuel and the mixture. The calculated actual flow rate is compared with a desired flow rate value, and a purge control valve is controlled based on results of the comparison. A basic amount of fuel supplied to the engine is corrected based on the calculated actual flow rate of the evaporative fuel.

25 Claims, 17 Drawing Sheets

FIG.7

| | θ TH0 | θ TH1 | ····· | θ TH15 |
|---|---|---|---|---|
| PBA0 | PCQO(0,0) | PCQO(0,1) | ····· | PCQO(0,15) |
| PBA1 | PCQO(1,0) | PCQO(1,1) | ····· | PCQO(1,15) |
| ⋮ | ⋮ | ⋮ | ⋱ | ⋮ |
| PBA15 | PCQO(15,0) | PCQO(15,1) | ····· | PCQO(15,15) |

FIG.8

| | | | |
|---|---|---|---|
| VS0 | VS1 | ····· | VS15 |
| η Q0 | η Q1 | ····· | η Q15 |

FIG.9

| | PCQ 1—0 | PCQ 1—1 | ····· | PCQ 1—15 |
|---|---|---|---|---|
| QH0 | VQ(0,0) | VQ(0,1) | ····· | VQ(0,15) |
| QH1 | VQ(1,0) | VQ(1,1) | ····· | VQ(1,15) |
| ⋮ | ⋮ | ⋮ | ⋱ | ⋮ |
| QH15 | VQ(15,0) | VQ(15,1) | ····· | VQ(15,15) |

*FIG.10*

| | PCQ 1—0 | PCQ 1—1 | ····· | PCQ 1—15 |
|---|---|---|---|---|
| QH0 | TQ(0,0) | TQ(0,1) | ····· | TQ(0,15) |
| QH1 | TQ(1,0) | TQ(1,1) | ····· | TQ(1,15) |
| ⋮ | ⋮ | ⋮ | ⋱ | ⋮ |
| QH15 | TQ(15,0) | TQ(15,1) | ····· | TQ(15,15) |

*FIG.20*

| | DUTY0 | DUTY1 | ····· | DUTY15 |
|---|---|---|---|---|
| PBA0 | PBQ(0,0) | PBQ(0,1) | ····· | PBQ(0,15) |
| PBA1 | PBQ(1,0) | PBQ(1,1) | ····· | PBQ(1,15) |
| ⋮ | ⋮ | ⋮ | ⋱ | ⋮ |
| PBA15 | PBQ(15,0) | PBQ(15,1) | ····· | PBQ(15,15) |

EVAPORATIVE FUEL-PURGING CONTROL SYSTEM AND AIR-FUEL RATIO CONTROL SYSTEM ASSOCIATED THEREWITH FOR INTERNAL COMBUSTION ENGINES

BACKGROUND OF THE INVENTION

1. Field of the Invention

This invention relates to an evaporative fuel-purging control system for controlling the flow rate of evaporative fuel from a fuel tank supplied to an intake system of an internal combustion engine, and an air-fuel ratio control system associated with the evaporative fuel-purging control system.

2. Prior Art

Conventionally, evaporative emission control systems have widely been used in internal combustion engines, which operate to prevent evaporative fuel (fuel vapor) from being emitted from a fuel tank into the atmosphere, by temporarily storing evaporative fuel from the fuel tank in a canister, and purging same into the intake system of the engine. Purging of evaporative fuel into the intake system causes instantaneous enriching of an air-fuel mixture supplied to the engine. If the purged evaporative fuel amount is small, the air-fuel ratio of the mixture will then be promptly returned to a desired value, with almost no fluctuation.

However, if the purged evaporative fuel amount is large, the air-fuel ratio of the mixture fluctuates. For example, a large amount of fuel vapor can be produced in the fuel tank immediately after refueling or fill-up. In order to prevent fluctuations in the air-fuel ratio due to purging of evaporative fuel (fuel vapor) on such an occasion, there has been proposed e.g. by Japanese Provisional Patent Publication (Kokai) No. 63-111277 a purging gas flow rate control system which reduces the purging amount of a mixture of evaporative fuel and air from the start of the engine immediately after refueling or fill-up until the speed of the vehicle in which the engine is installed reaches a predetermined value, and also reduces the purging amount of the mixture after the vehicle speed has reached the predetermined value and until the accumulated time period over which the vehicle speed exceeds the predetermined value reaches a predetermined value.

Further, an air-fuel ratio control system is also known, which first effects purging of evaporative fuel in such a small amount as to cause almost no fluctuation of the air-fuel ratio, then detects an amount of variation of an air-fuel ratio correction coefficient applied to feedback control of the air-fuel ratio, which variation is caused by the purging, forecast from the detected variation amount a value of the air-fuel ratio correction coefficient which should be assumed when the purged evaporative fuel amount is large, and thereafter applies the forecast value as the air-fuel ratio correction coefficient in the feedback control when the actual purged evaporative fuel amount becomes large, so as to reduce the fuel amount supplied to the engine, whereby fluctuations in the air-fuel ratio can be suppressed even when the purged amount is large (e.g. Japanese Provisional Patent Publication (Kokai) No. 62-131962).

However, the former conventional system is liable to fail to perform accurate control of the air-fuel ratio since the actual purged amount (the actual purged amount of the mixture of evaporative fuel and air) is not detected in controlling the flow rate of the purged mixture. More specifically, an amount of evaporative fuel produced by refueling and hence the resulting concentration of evaporative fuel in the mixture supplied from the purging passage into the intake system after refueling depend on an amount of fuel remaining in the fuel tank just before refueling, so that the amount of purged evaporative fuel after refueling varies. According to this conventional system, therefore, if the purging amount of the mixture is set to a relatively large value in expectation of the concentration of evaporative fuel in the mixture after refueling being relatively small, fluctuations can inevitably occur in the air-fuel ratio when a mixture with a high concentration of evaporative fuel is supplied by purging into the intake system. On the other hand, if the purging amount is set to a relatively small value in expectation of the concentration of evaporative fuel in the mixture after refueling being relatively high, the occurrence of fluctuations in the air-fuel ratio can be avoided, but the evaporative emission control cannot be performed to an adequate extent, if a mixture with a low concentration of evaporative fuel is then supplied by purging into the intake system.

Further, in the latter conventional system, the actual purged amount is not directly detected for the control of the air-fuel ratio, but the actual purged amount is estimated from the variation in the air-fuel ratio correction coefficient caused by the small purging amount, and at the same time, a variation amount in the air-fuel ratio to be caused by a large purging amount is forecast from the variation amount in the air-fuel ratio caused by the small purging amount. Therefore, the variation in the coefficient cannot be forecast accurately, which prevents accurate control of the air-fuel ratio from being carried out when purging of the evaporative fuel is effected.

Thus, both of the conventional systems can undergo fluctuations in the air-fuel ratio, resulting in degraded exhaust emission characteristics and fluctuations in engine output torque.

SUMMARY OF THE INVENTION

It is an object of the invention to provide an evaporative fuel purging control system which is capable of accurately controlling the flow rate of evaporative fuel supplied to the intake system of the engine.

It is a further object of the invention to provide an air-fuel ratio control system which is capable of accurately controlling the air-fuel ratio of a mixture supplied to the engine.

It is another object of the invention to provide a system which is capable of accurately detecting an actual volumetric flow rate of evaporative fuel evaporated in the fuel tank and supplied to the intake system of the engine, and/or the concentration of the evaporative fuel evaporated in the fuel tank.

To attain the first-mentioned object, according to a first aspect of the present invention, there is provided an evaporative fuel-purging control system for an internal combustion engine having a fuel tank and an intake passage, the evaporative fuel-purging control system including a canister for adsorbing evaporative fuel generated from the fuel tank, a purging passage connecting between the canister and the intake passage for purging a gaseous mixture containing the evaporative fuel therethrough into the intake passage, and a purge control valve arranged across the purging passage for controlling the flow rate of the evaporative fuel supplied to the intake passage.

The evaporative fuel-purging control system according to the first aspect of the invention is characterized by comprising:

a mass flowmeter arranged across the purging passage for outputting an output value indicative of a flow rate of the gaseous mixture being purged through the purging passage;

purging flow rate-calculating means for calculating a value of the flow rate of the gaseous mixture flowing through the purging passage, based on a plurality of operating parameters of the engine;

actual evaporative fuel flow rate-calculating means for calculating an actual flow rate of the evaporative fuel flowing through the purging passage, based on the output value from the mass flowmeter and the calculated value of the flow rate of the gaseous mixture obtained by the purging flow rate-calculating means;

desired evaporative fuel flow rate-setting means responsive to operating conditions of the engine for setting a desired flow rate of the evaporative fuel; and purge control means for comparing the desired flow rate of the evaporative fuel with the actual flow rate of the evaporative fuel, and controlling an opening of the purge control valve, based on results of the comparison.

In one preferred form of the first aspect of the invention, the purge control valve is a linear control type.

Specifically, the engine includes a throttle valve having a valve element and arranged in the intake passage, and the purging flow rate-calculating means calculates the flow rate of the mixture by multiplying a basic flow rate determined by an opening of the throttle valve and pressure within the intake passage by a flow rate ratio dependent on the opening of the purge control valve.

Preferably, the purging passage has a port opening into the intake passage, the port being located such that when the throttle valve is open, the port is downstream of the valve element of the throttle valve, whereas when the throttle valve is closed, the port is upstream of the valve element of the throttle valve.

More preferably, the purging passage further includes a bypass passage bypassing the purge control valve, the bypass passage being provided with a low flow rate jet restriction.

In another preferred form of the first aspect of the invention, the purge control valve is a duty control type.

Specifically, the purging flow rate-calculating means calculates the flow rate of the gaseous mixture, based on a duty ratio of the purge control valve and pressure within the intake passage.

Preferably, the purging passage has a port opening into the intake passage at a location downstream of a throttle valve arranged in the intake passage.

To attain the second-mentioned object, according to a second aspect of the invention, there is provided an air-fuel ratio control system for an internal combustion engine having a fuel tank and an intake passage, the air-fuel ratio control system including a canister for adsorbing evaporative fuel generated from the fuel tank, a purging passage connecting between the canister and the intake passage for purging a gaseous mixture containing the evaporative fuel therethrough into the intake passage, and a purge control valve arranged across the purging passage for controlling the flow rate of the evaporative fuel supplied to the intake passage.

The air-fuel ratio control system according to the second aspect of the invention is characterized by comprising:

a mass flowmeter arranged across the purging passage for outputting an output value indicative of a flow rate of the gaseous mixture being purged through the purging passage;

purging flow rate-calculating means for calculating a value of the flow rate of the gaseous mixture flowing through the purging passage, based on a plurality of operating parameters of the engine;

actual evaporative fuel flow rate-calculating means for calculating an actual flow rate of the evaporative fuel flowing through the purging passage based on the output value from the mass flowmeter and the calculated value of the flow rate of the gaseous mixture obtained by the purging flow rate-calculating means; and correcting means for correcting a basic amount of fuel supplied to the engine based on the calculated actual flow rate of the evaporative fuel.

Preferably, the correcting means calculates a weight per unit time of the evaporative fuel supplied into the intake passage, based on the calculated actual flow rate of the evaporative fuel, and corrects the basic amount of fuel supplied to the engine by the use of an evaporative fuel-dependent correction coefficient calculated based on a ratio of the calculated weight per unit time of the evaporative fuel to a weight per unit time of fuel supplied to the engine by injection.

More preferably, the correcting means corrects the basic amount of fuel supplied to the engine by an air-fuel ratio correction coefficient for multiplying the basic amount of fuel thereby, the air-fuel ratio correction coefficient being modified by multiplying the air-fuel ratio correction coefficient by a ratio of a present value of the evaporative fuel-dependent correction to an immediately preceding value thereof.

In one preferred form of the second aspect of the invention, the engine includes a throttle valve having a valve element and arranged in the intake passage, and the purge control valve is a linear control type, the purging flow rate-calculating means calculating the flow rate of the gaseous mixture by multiplying a basic flow rate determined by an opening of the throttle valve and pressure within the intake passage by a flow rate ratio dependent on an opening of the purge control valve.

Preferably, the purging passage has a port opening into the intake passage, the port being located such that when the throttle valve is open, the port is downstream of the valve element of the throttle valve, whereas when the throttle valve is closed, the port is upstream of the valve element of the throttle valve.

In another preferred form of the second aspect of the invention, the purge control valve is a duty control type, and the purging flow rate-calculating means calculates the flow rate of the gaseous mixture, based on a duty ratio of the purge control valve and pressure within the intake passage.

Preferably, the purging passage has a port opening into the intake passage at a location downstream of a throttle valve arranged in the intake passage.

To attain the third-mentioned object, according to a third aspect of the invention, there is provided an evaporative fuel flow rate-detecting system for detecting a flow rate of evaporative fuel drawn into an internal combustion engine having a fuel tank and an intake passage, the evaporative fuel flow rate-detecting system including a canister for adsorbing evaporative fuel generated from the fuel tank, a purging passage connecting between the canister and the intake passage for purging a gaseous mixture containing the evaporative fuel therethrough into the intake passage, and a purge control valve arranged across the purging passage for controlling the flow rate of the evaporative fuel supplied to the intake passage.

The evaporative fuel flow rate-detecting system according to the third aspect of the invention is characterized by comprising:

a mass flowmeter arranged across the purging passage for outputting an output value indicative of a flow rate of the gaseous mixture being purged through the purging passage;

purging flow rate-calculating means for calculating a value of the flow rate of the gaseous mixture flowing through the purging passage, based on a plurality of operating parameters of the engine; and actual evaporative fuel flow rate-calculating means for calculating an actual flow rate of the evaporative fuel flowing through the purging passage, based on the output value from the mass flowmeter and the calculated value of the flow rate of the gaseous mixture obtained by the purging flow rate-calculating means.

In one preferred form of the third aspect of the invention, the purge control valve is a linear control type, and the engine includes a throttle valve having a valve element and arranged in the intake passage, the purging flow rate-calculating means calculating the flow rate of the mixture by multiplying a basic flow rate determined by an opening of the throttle valve and pressure within the intake passage by a flow rate ratio dependent on the opening of the purge control valve.

Preferably, the purging passage has a port opening into the intake passage, the port being located such that when the throttle valve is open, the port is downstream of the valve element of the throttle valve, whereas when the throttle valve is closed, the port is upstream of the valve element of the throttle valve.

In another preferred form of the third aspect of the invention, the purge control valve is a duty control type, and the purging flow rate-calculating means calculates the flow rate of the gaseous mixture based on a duty ratio of the purge control valve and pressure within the intake passage.

Preferably, the engine includes a throttle valve arranged in the intake passage, and the purging passage has a port opening into the intake passage at a location downstream of the throttle valve.

To attain the third-mentioned object, according to a fourth aspect of the invention, there is provided an evaporative fuel concentration-detecting system for an internal combustion engine having a fuel tank and an intake passage, the evaporative fuel concentration system detecting concentration of evaporative fuel in a gaseous mixture containing evaporative fuel and drawn into the engine, the evaporative fuel concentration-detecting system including a canister for adsorbing evaporative fuel generated from the fuel tank, a purging passage connecting between the canister and the intake passage for purging a gaseous mixture containing the evaporative fuel therethrough into the intake passage, and a purge control valve arranged across the purging passage for controlling the flow rate of the evaporative fuel supplied to the intake passage.

The evaporative fuel concentration-detecting system according to the fourth aspect of the invention is characterized by comprising:

a mass flowmeter arranged across the purging passage for outputting an output value indicative of a flow rate of the gaseous mixture being purged through the purging passage;

purging flow rate-calculating means for calculating a value of the flow rate of the gaseous mixture flowing through the purging passage, based on a plurality of operating parameters of the engine;

actual evaporative fuel flow rate-calculating means for calculating an actual flow rate of the evaporative fuel flowing through the purging passage, based on the output value from the mass flowmeter and the calculated value of the flow rate of the gaseous mixture obtained by the purging flow rate-calculating means;

actual purging flow rate-calculating means for calculating an actual flow rate of the gaseous mixture flowing through the purging passage based on the output value from the mass flowmeter and the calculated value of the flow rate of the gaseous mixture obtained by the purging flow rate-calculating means; and concentration-calculating means for calculating concentration of the evaporative fuel in the gaseous mixture from the actual flow rate of the gaseous mixture and the actual flow rate of the evaporative fuel.

In one preferred form of the fourth aspect of the invention, the engine includes a throttle valve having a valve element and arranged in the intake passage, and the purge control valve is a linear control type, the purging flow rate-calculating means calculating the flow rate of the mixture by multiplying a basic flow rate determined by an opening of the throttle valve and pressure within the intake passage by a flow rate ratio dependent on an opening of the purge control valve.

Preferably, the purging passage has a port opening into the intake passage, the port being located such that when the throttle valve is open, the port is downstream of the valve element of the throttle valve, whereas when the throttle valve is closed, the port is upstream of the valve element of the throttle valve.

In another preferred form of the fourth aspect of the invention, the purge control valve is a duty control type, and the purging flow rate-calculating means calculates the flow rate of the gaseous mixture based on a duty ratio of the purge control valve and pressure within the intake passage.

Preferably, the engine includes a throttle valve arranged in the intake passage, and the purging passage has a port opening into the intake passage at a location downstream of the throttle valve.

The above and other objects, features, and advantages of the invention will become more apparent from the ensuring detailed description taken in conjunction with the accompanying drawings.

BRIEF DESCRIPTION OF THE DRAWINGS

FIG. 7 is a view showing a map for calculating a basic PC flow rate PCQ0;

FIG. 8 is a view showing a table for calculating a flow rate ratio $\eta$Q;

FIG. 9 is a view showing a map for calculating the evaporative fuel flow rate VQ;

FIG. 10 is a view showing a map for calculating a vapor flow rate TQ;

FIG. 20 is a view showing a map for calculating the PB flow rate PBQ; and

DETAILED DESCRIPTION

The invention will now be described in detail with reference to the drawings showing embodiments thereof.

Figure 1:
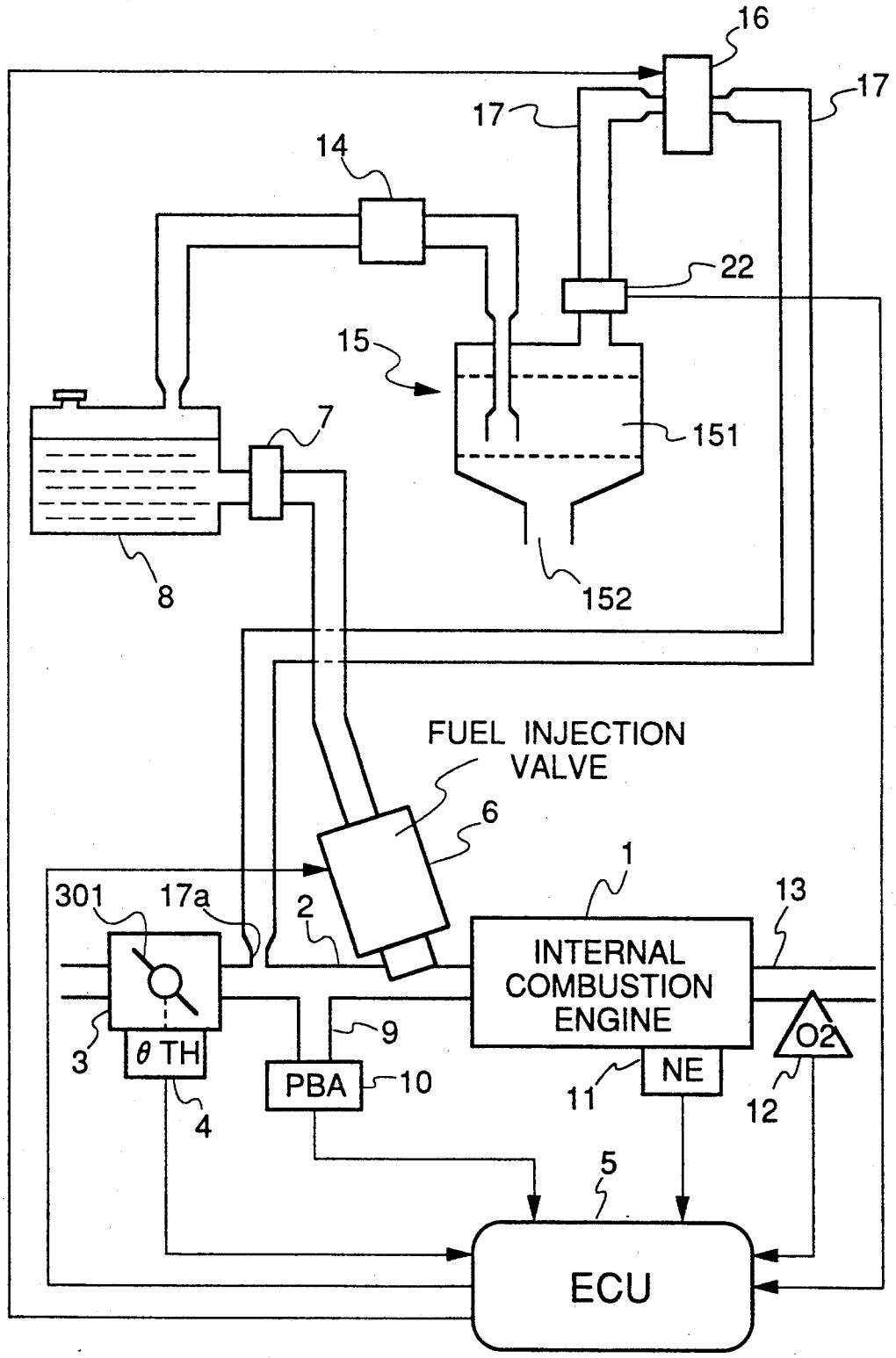
FIG. 1 is a block diagram showing the arrangement of a first embodiment of the invention.

Referring first to FIG. 1, there is illustrated the whole arrangement of a fuel supply control system of an internal combustion engine, which is equipped with an evaporative fuel-purging control system, and an air-fuel ratio control system according to a first embodiment of the invention. In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for generating an electric signal indicative of the sensed throttle valve opening and supplying same to an electronic control unit (hereinafter called "the ECU") 5. The ECU 5 forms purging flow rate-calculating means, actual evaporative fuel flow rate-calculating means, and desired evaporative fuel flow rate-setting means, purge control means, correcting means, and concentration-calculating means.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of predetermined crank angles whenever the crankshaft rotates through 180 degrees, the pulse being supplied to the ECU 5.

An $O_2$ sensor 12 as an exhaust gas ingredient concentration sensor is mounted in an exhaust pipe 13 connected to the cylinder block of the engine 1, for sensing the concentration of oxygen present in exhaust gases emitted from the engine 1 and supplying an electric signal indicative of the sensed oxygen concentration to the ECU 5.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve 16 in the form of a linear control valve which has a solenoid, not shown, for driving a valve element thereof, not shown. The solenoid of the purge control valve 16 is connected to the ECU 5 and controlled by a signal supplied therefrom to change the valve opening (EPCV) linearly. According to this evaporative emission control system, evaporative fuel or fuel vapor (hereinafter merely referred to as "evaporative fuel") generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at the flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evaporative fuel generated within the fuel tank 8 is prevented from being emitted into the atmosphere.

A mass flowmeter 22 is arranged across the purging passage 17 at a location between the canister 15 and the purge control valve 16, which detects a flow rate of the mixture of evaporative fuel and air flowing in the purging passage 17 and supplies a signal indicative of the detected flow rate to the ECU 5. The mass flowmeter 22 is a hot wire type which utilizes the nature of a platinum wire that when the platinum wire is heated by electric current applied thereto and at the same time exposed to a flow of gas, the platinum wire loses its heat to decrease in temperature so that its electric resistance decreases. Alternatively, it may be a thermo type comprising a thermistor of which the electric varies due to self-heating by electric current applied thereto or a change in the ambient temperature. Both the types of mass flowmeter detect variations in the concentration of evaporative fuel through variations in the electric resistance thereof.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes programs for calculating a correction coefficient KO2, referred to hereinafter, and the valve opening amount (EPCV), etc., memory means storing a Ti map, referred to hereinafter, and programs executed by the CPU and for storing results of calculations therefrom, etc., and an output circuit which outputs driving signals to the fuel injection valves 6 and the purge control valve 16.

The CPU operates in response to the above-mentioned engine parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 6 are to be opened, by the use of the following equation (1) in synchronism with inputting of TDC signal pulses to the ECU 5:

$$TOUT = Ti \times KO_2 \times K1 + K2 \quad (1)$$

where Ti represents a basic value of the fuel injection period TOUT (a basic fuel amount) of the fuel injection valves 6, which is read from the Ti map in accordance with the engine rotational speed NE and the intake pipe absolute pressure PBA.

$KO_2$ represents an air-fuel ratio correction coefficient whose value is determined in response to the oxygen concentration in the exhaust gases detected by the $O_2$ sensor 12, during air-fuel ratio feedback control, while it is set to respective predetermined appropriate values while the engine is in predetermined operating regions (the open-loop control regions) other than the feedback control region.

K1 and K2 represent other correction coefficients and correction variables, respectively, which are calculated based on various engine parameter signals to such values as to optimize operating characteristics of the engine such as fuel consumption and accelerability depending on operating conditions of the engine.

The CPU supplies through the output circuit, the fuel injection valves 6 with driving signals corresponding to the calculated fuel injection period TOUT determined as above, over which the fuel injection valves 6 are opened.

Next, with reference to FIGS. 2 to 5, there will be described a manner of calculating a flow rate VQ of evaporative fuel supplied to the throttle body 3 from a PC port (purge-control port) 17*a* of the purging passage 17 opening into the intake pipe 2 (actual flow rate of evaporative fuel; hereinafter referred to as "the vapor flow rate"). The PC port (purge-control port) 17*a* is located such that when the throttle valve 301 is open, it is positioned downstream of the valve element, while when the throttle valve 301 is closed, it is positioned upstream of the valve element. The term "PC flow rate", used hereinafter, means a flow rate of a mixture of evaporative fuel and air, which is calculated according to the throttle valve opening $\theta$TH and the intake pipe absolute pressure PBA. When air alone is flowing in the purging passage 17, i.e. when the concentration of evaporative fuel (hereinafter referred to as "vapor concentration") is 0%, the PC flow rate is equal to the purging flow rate (the actual flow rate of the mixture of evaporative fuel and air) TQ, while when the vapor concentration is not 0%, the former is maintained in predetermined relationship with the latter, as hereinafter described.

Figure 2:
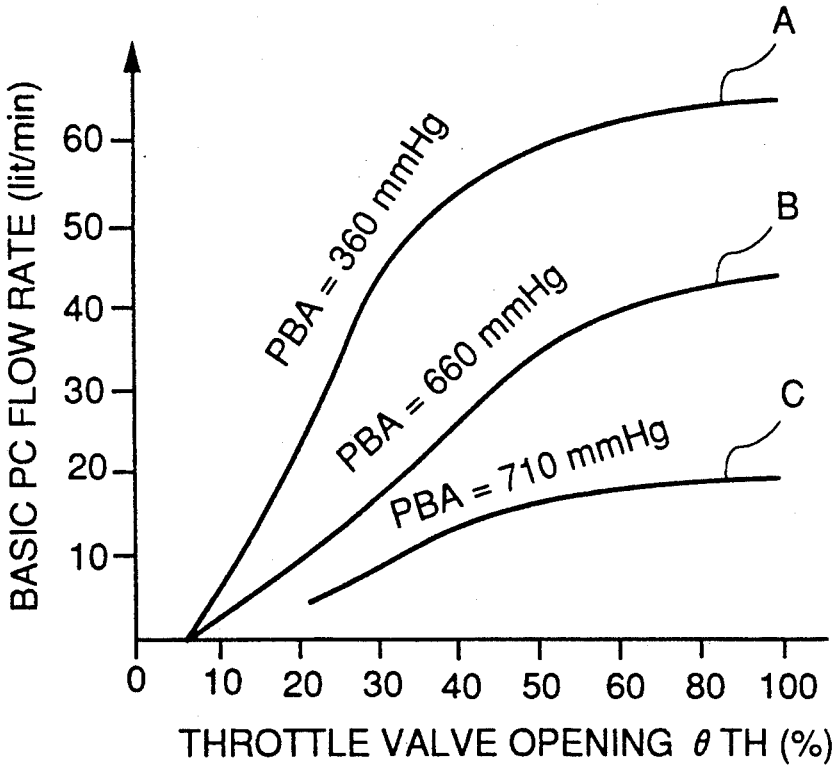
FIG. 2 is a graph showing the relationship between throttle valve opening ($\theta$TH), intake pipe absolute pressure (PBA), and a basic flow rate PCQ0.

FIG. 2 shows, by way of example, the relationship between the throttle valve opening $\theta$TH (%) and a basic PC flow rate PCQ0 (l/min), which holds when the vapor concentration $\beta$ is 0% (i.e. the air concentration is 100%). In the figure, the curves A, B, and C correspond, respectively, to different values of the intake pipe absolute pressure PBA, i.e. 360 mmHg, 660 mmHg, and 710 mmHg. The basic PC flow rate PCQ0 represents a value of the PC flow rate assumed when the purge control valve 16 is fully open. By the use of the FIG. 2 relationship between the throttle valve opening $\theta$TH(%) and the intake pipe absolute pressure PBA, and the basic PC flow rate PCQ0, which is dependent on the vapor concentration, the basic PC flow rate PCQ0 is calculated according to the throttle valve opening $\theta$TH and the intake pipe absolute pressure PBA.

Figure 3:
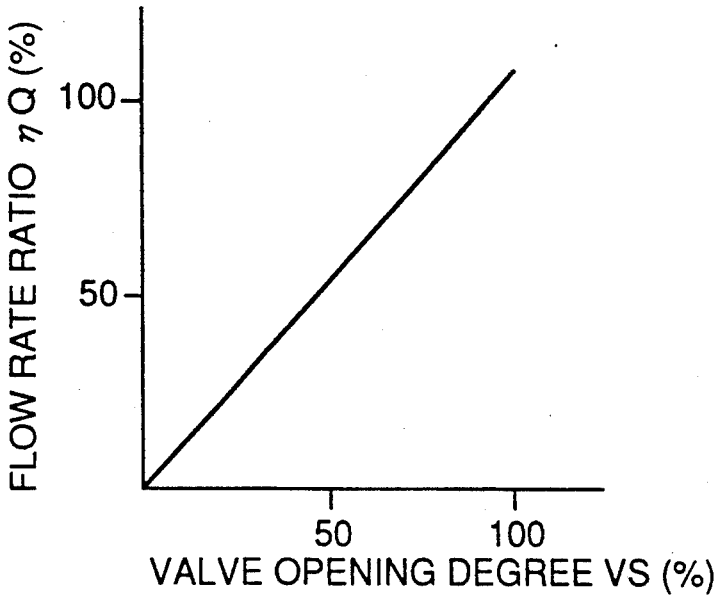
FIG. 3 is a graph showing a flow rate characteristic of flow through a purging passage 17.

FIG. 3 shows the flow rate characteristic of the purge control valve 16. In the figure, the flow rate ratio $\eta$Q (%) represents the ratio of the PC flow rate to its maximum value, which is determined by the valve opening degree VS (%) of the purge control valve 16. The PC flow rate PCQ1 is obtained by multiplying the basic PC flow rate PCQ0 by the flow rate ratio $\eta$Q.

Figure 4:
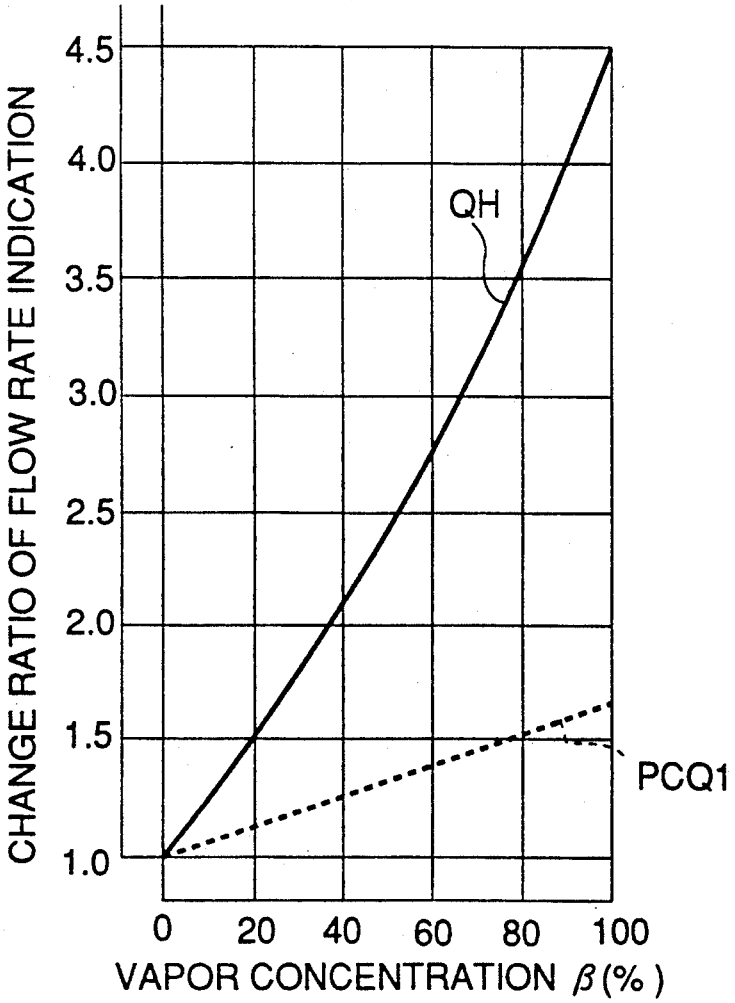
FIG. 4 is a graph showing the relationship between evaporative fuel concentration $\beta$ and a change ratio of flow rate indication.

FIG. 4 shows the relationship between the vapor concentration $\beta$ in the mixture and a change ratio of flow rate indication. In the figure, the solid line curve represents the output value QH of the hot-wire type mass flowmeter 22, and the broken line curve the PC flow rate PCQ1.

Figure 5A:
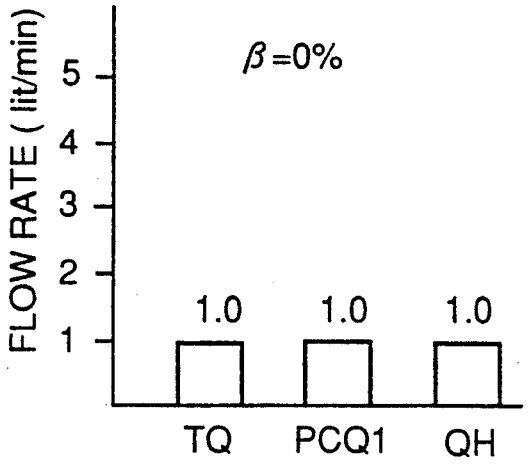
FIG. 5*a* is a graph useful in explaining the relationship between a PC flow rate PCQ1 and an output value QH from a hot wire-type mass flowmeter.
Figure 5B:
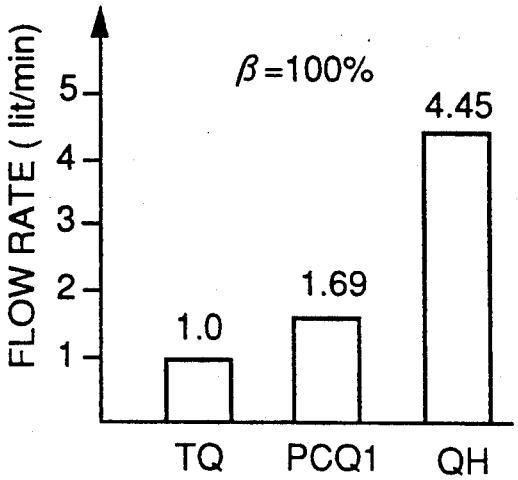
FIG. 5*b* is a graph useful in explaining the relationship between the PC flow rate PCQ1 and the output value QH from the hot wire-type mass flowmeter.
Figure 5C:
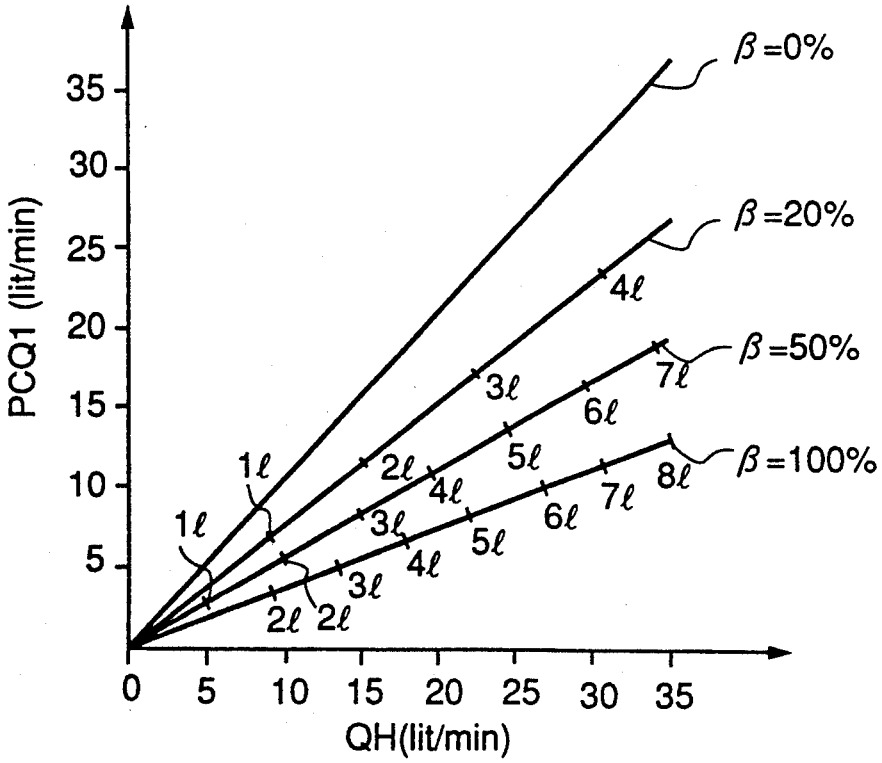
FIG. 5*c* is a graph useful in explaining the relationship between the PC flow rate PCQ1 and the output value QH from the hot wire-type mass flowmeter.

The change ratio of flow rate indication represents the ratio of an indicated flow rate value (i.e. the QH value or the PCQ1 value) obtained when $\beta>0\%$ to one obtained when $\beta=0\%$, provided that the purging flow rate TQ is held constant. In other words, the change ratio of flow rate indication represents the ratio of the QH value or the PCQ1 value to the purging flow rate TQ, i.e. $\theta$H/TQ or PCQ1/TQ. For example, when $\beta=0\%$, the relationship of PCQ1=QH=TQ=1 (l/min) holds, as shown in FIG. 5*a*, whereas when $\beta=100\%$, the relationships of PCQ1=1.69 (l/min) and QH=4.45 (l/min) hold while TQ=1 (l/min), as shown in FIG. 5*b*. Therefore, by the use of the relationship of FIG. 4, the vapor concentration $\beta$, the vapor flow rate VQ, and the purging flow rate TQ can be calculated according to the PC flow rate PCQ1 and the output value QH from the hot-wire type mass flowmeter 11. More specifically, the relationship between QH, PCQ1, $\beta$, and VQ can be represented in a graph shown in FIG. 5*c*. By the use of the relationship of FIG. 5*c*, the vapor concentration $\beta$, the vapor flow rate VQ, and the purging flow rate TQ can be determined from the QH value and the PCQ1 value. In the figure, the VQ value is indicated by 1l, 2l, . . . on the $\beta$ lines, and the TQ value can be obtained from VQ/$\beta$.

Figure 6:
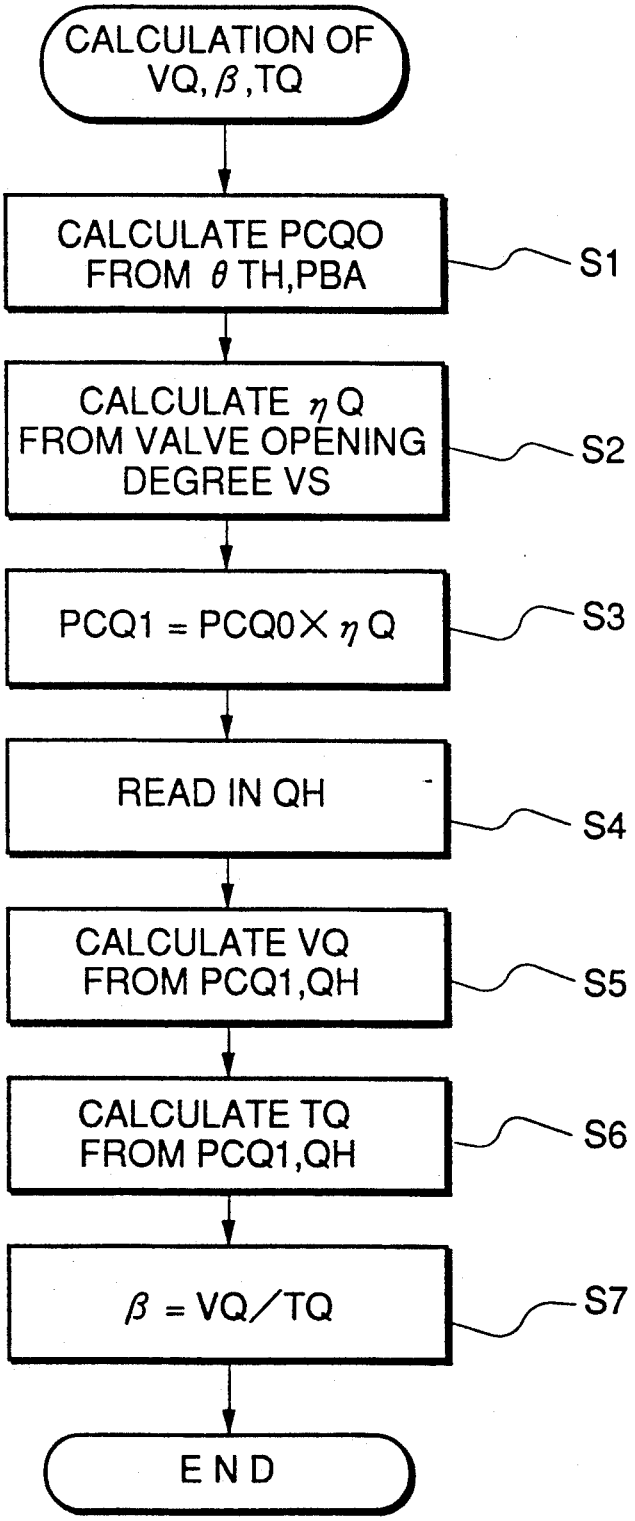
FIG. 6 is a flowchart of a program for calculating evaporative fuel flow rate VQ and the evaporative fuel concentration $\beta$.

FIG. 6 shows a program for calculating the vapor flow rate VQ mentioned hereinabove. At a step S1 in the figure, the basic PC flow rate PCQ0 is determined according to the throttle valve opening $\theta$TH and the intake pipe absolute pressure PBA (see FIG. 2). Then, at a step S2, the flow rate ratio $\eta$Q is determined according to the valve opening degree VS of the purge control valve 16 (see FIG. 3). The basic PC flow rate PCQ0 is read from a PCQ0 map as shown in FIG. 7, in which predetermined PCQ0 values PCQ0(0, 0)~PCQ0(15, 15) are set corresponding to predetermined throttle opening values $\theta$TH0~$\theta$TH15 and predetermined intake pipe absolute pressure values PBA0~PBA15. When the $\theta$TH value and/or the PBA value falls between adjacent predetermined $\theta$TH and/or PBA values, the PCQ0 value is calculated by an interpolation method. The flow rate ratio $\eta$Q is read from a $\theta$Q table as shown in FIG. 8, in which predetermined $\eta$Q values $\eta$Q0~$\eta$Q15 are set corresponding to predetermined valve opening values VS0~VS15. When the VS value falls between adjacent predetermined VS values, the $\eta$Q value is calculated by an interpolation method.

At the next step S3, the PC flow rate PCQ1 is calculated by the use of the following equation (2):

$$PCQ1=PCQ0\times\eta Q \quad (2)$$

Then, at a step S4, the output value QH of the hot-wire type mass flowmeter 22 is read in, followed by determining the vapor flow rate VQ according to the QH value and the PCQ1 value through reading from a VQ map and interpolation if required, at a step S5. An example of the VQ map is shown in FIG. 9, which is based upon the relationship of FIG. 5*c*, and in which predetermined VQ values VQ(0, 0)~VQ(15, 15) are set corresponding to predetermined $\theta$H values $\theta$H0~$\theta$H15 and predetermined PCQ1 values PCQ1-0~PCQ1-15.

At a step S6, the purging flow rate TQ is read from a TQ map according to the output value QH and the PC flow rate PCQ1, and calculated by interpolation, if required. In the TQ map, predetermined purging flow rate TQ values (0,0) to (15,15) are provided based on the relationship between the PC flow rate PCQ1 and the output value QH described hereinbefore with reference to FIG. 5*c* in a manner similar to the VQ map, e.g. as shown in FIG. 10. At a step S7, the vapor flow rate $\beta$ (=VQ/TQ) is calculated, followed by terminating the present program.

Figure 11:
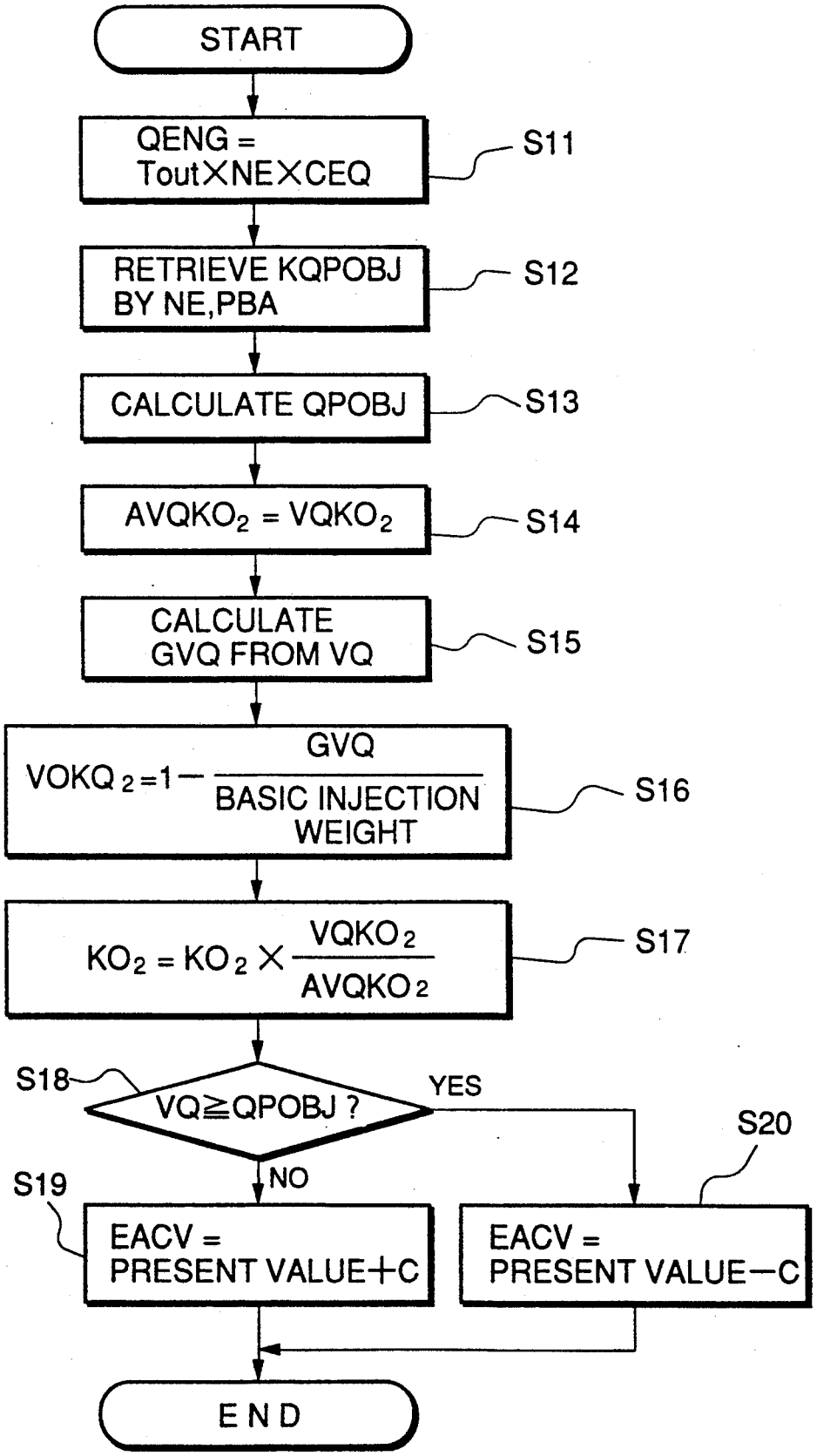
FIG. 11 is a flowchart of a program for controlling purge control valve opening and a fuel supply amount in response to the evaporative fuel flow rate VQ.

FIG. 11 shows a program for calculating a vapor flow rate-dependent correction coefficient $VQKO_2$ and the valve opening amount EPCV. This program is executed by the CPU of the ECU 5. The vapor flow rate-dependent correction coefficient $VQKO_2$ is used for correcting the air-fuel ratio correction coefficient $KO_2$ in response to the vapor flow rate VQ, while the valve opening amount EPCV is a control parameter value for controlling the valve opening degree VS of the purge control valve 16. As the valve opening amount EPCV increases, the opening of the purge control valve increases, which results in an increase in the vapor flow rate VQ.

First, at a step S11 in FIG. 11, a flow rate QENG of air drawn into the engine 1 or intake air is calculated by the use of the following equation (3):

$$QENG=TOUT\times NE\times CEQ \quad (3)$$

where TOUT represents the fuel injection period calculated by the equation (1), and CEQ a constant for converting the product of TOUT×NE to the flow rate QENG of intake air.

At a step S12, a desired ratio KQPOBJ of the vapor flow rate to the flow rate QENG of intake air supplied to the engine is calculated from a KQPOBJ map according to the detected engine rotational speed NE and intake pipe absolute pressure PBA. The KQPOBJ map is one in which values of the desired ratio KQPOBJ are set corresponding, respectively, to combinations of a plurality of predetermined values of the engine rotational speed NE and a plurality of predetermined values of the intake pipe absolute pressure PBA.

At a step S13, a desired vapor flow rate QPOBJ is calculated by applying the flow rate QENG of intake air and the desired ratio KQPOBJ to the following equation (4):

$$QPOBJ=QENG\times KQPOBJ \quad (4)$$

The desired vapor flow rate QPOBJ may be corrected depending on the engine coolant temperature TW.

At a step S14, the immediately preceding value of the vapor flow rate-dependent correction coefficient $VQKO_2$ is temporarily stored as a variable $AVQKO_2$ in order to use the value at a step S17, referred to hereinafter.

At a step S15, the vapor flow rate VQ (l/min.) calculated by the program shown in FIG. 6 is converted to a gasoline weight-equivalent flow rate GVQ (g/min.) which is a flow rate in terms of the weight of gasoline in liquid state per minute which is equivalent to the vapor flow rate VQ (l/min.) in terms of the volume of vapor per minute, by the use of the following equation (5):

$$GVQ=(VQ/VMOL)\times\text{molecular weight of gasoline vapor} \quad (5)$$

where VMOL represents a value of molar volume of one mole of molecules, which is conveniently indicated by 22.4 l/min. to be assumed at a temperature of 0° C. The molecular weight of the gasoline vapor is approx. 64.

At a step S16, the gasoline weight-equivalent flow rate GVQ (g/min.) thus obtained is applied to the following equation (6) to calculate the vapor flow rate-dependent correction coefficient $VQKO_2$.

$$VQKO_2 = 1 - (GVQ/\text{basic injection weight}) \quad (6)$$

where the basic injection weight is a value obtained by converting the basic value Ti of the fuel injection period TOUT to the weight of fuel injected per unit time (minute).

The vapor flow rate-dependent correction coefficient $VQKO_2$ thus obtained assumes a value of 1.0 when the purge control valve 16 is closed, and a value lower than 1.0 when the purge control valve 16 is open to carry out purging of evaporative fuel.

At a step S17, the air-fuel ratio correction coefficient $KO_2$ is modified by the following equation (7):

$$KO_2 = KO_2 \times VQKO_2 / AVQKO_2 \quad (7)$$

The modified $KO_2$ value is applied to the equation (1) to calculate the fuel injection period, whereby fuel is supplied to the engine 1 via the fuel injection valve 6 in amounts controlled so as to prevent fluctuations in the air-fuel ratio caused by variations in the purged amount of evaporative fuel.

Further, at a step S18, it is determined whether or not the vapor flow rate VQ obtained at the step S13 is equal to or larger than the desired vapor flow rate QPOBJ obtained at the step S3.

If the answer to the question of the step S18 is negative (No), i.e. if the calculated vapor flow rate VQ is smaller than the desired vapor flow rate QPOBJ, the control amount EPCV determining the opening of the purge control valve 16 is increased from the present value by a predetermined value C at a step S19, to thereby increase the vapor flow rate, causing the evaporative emission control system to suppress emission of evaporative fuel to an increased extent, followed by terminating the present program. The predetermined value C is a constant for renewal of the value of EPCV. On the other hand, if the answer to the question of the step S18 is affirmative (Yes), i.e. if the calculated vapor flow rate VQ is equal to or larger than the desired vapor flow rate QPOBJ, the control amount EACV is decreased from the present value by the predetermined value C at a step S20, to thereby reduce the vapor flow rate and hence prevent degradation in the responsiveness in the air-fuel ratio feedback control, followed by terminating the present program.

In the above described manner, the actual vapor flow rate VQ is calculated, based on which the fuel injection period TOUT is corrected (step S17) to thereby prevent fluctuations in the air-fuel ratio to be caused by purging of evaporative fuel, and at the same time the opening of the purge control valve 16 is controlled depending on the calculated vapor flow rate (steps S19, S20) to thereby prevent the average value of the air-fuel ratio correction coefficient from being largely deviated from a value of 1.0. This makes it possible to prevent degradation in the responsiveness in the air-fuel ratio feedback control which may occur when the average value, which is used as an initial value of the air fuel ratio correction coefficient $KO_2$ upon transition of the air-fuel ratio control from the open-loop mode to the feedback control mode, is largely deviated from the value of 1.0.

Figure 12A:
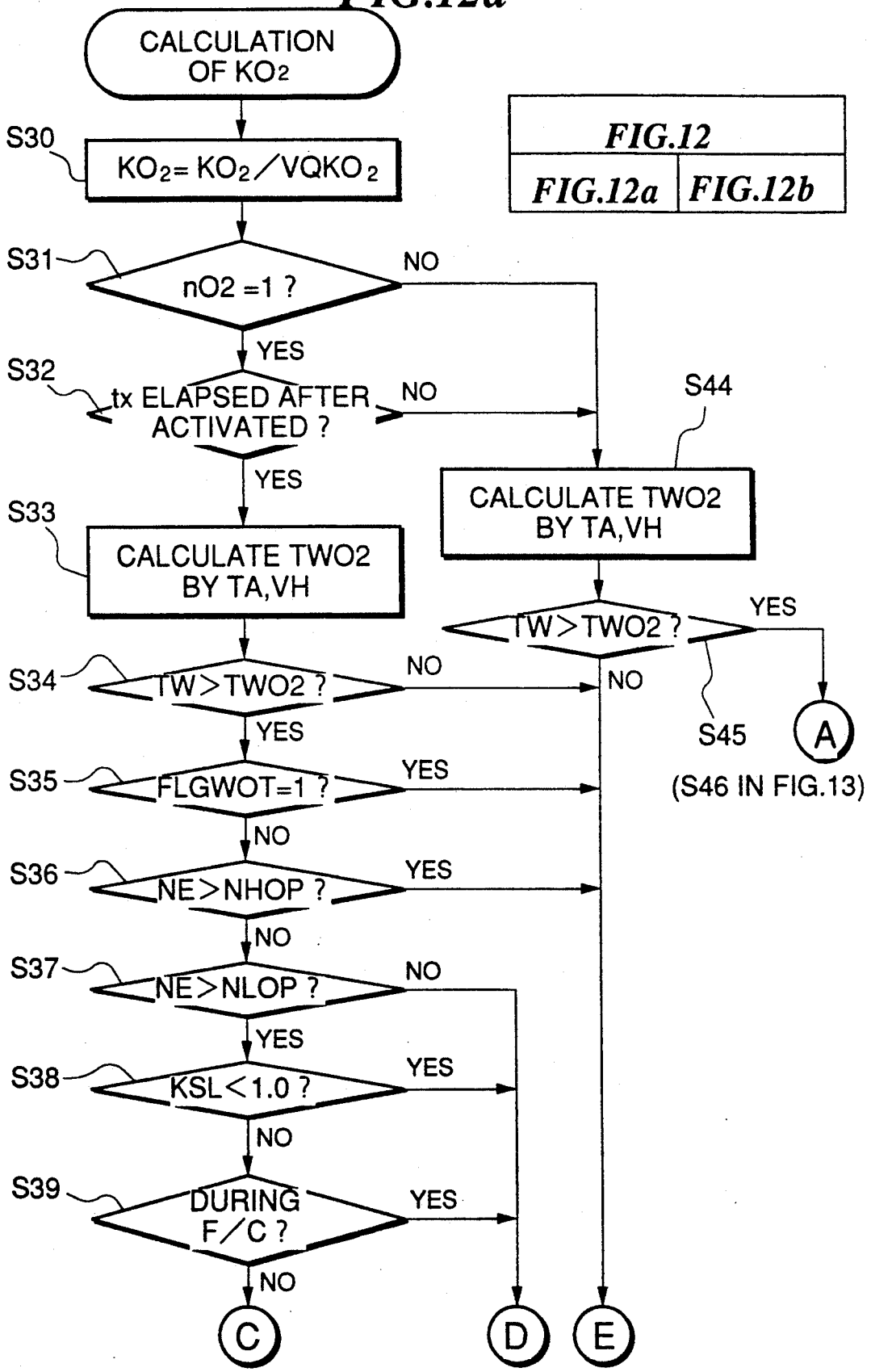
FIGS. 12*a* and 12*b* are flowcharts of a program for calculating an air-fuel ratio correction coefficient $KO_2$.
Figure 12B:
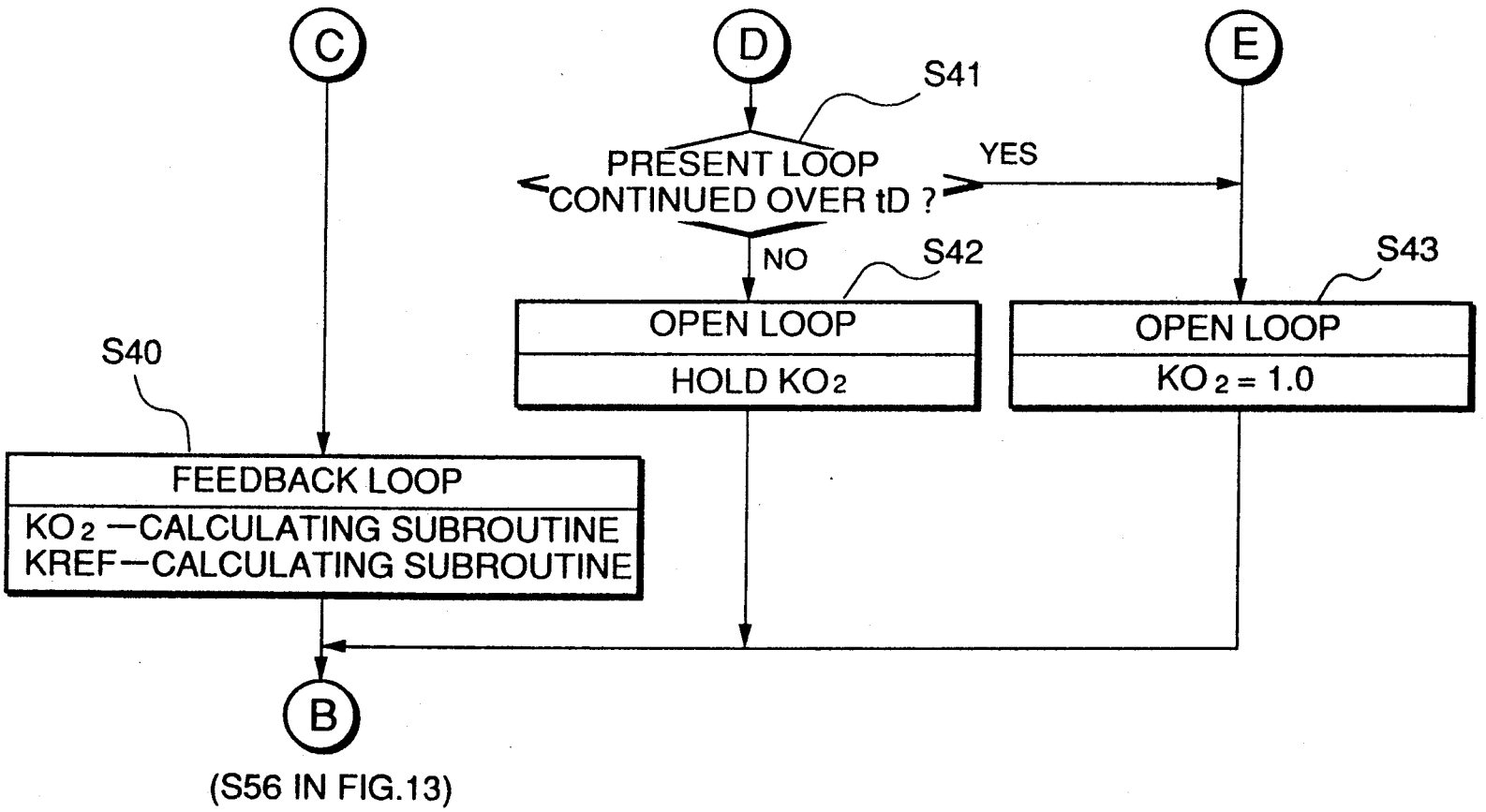
Figure 13:
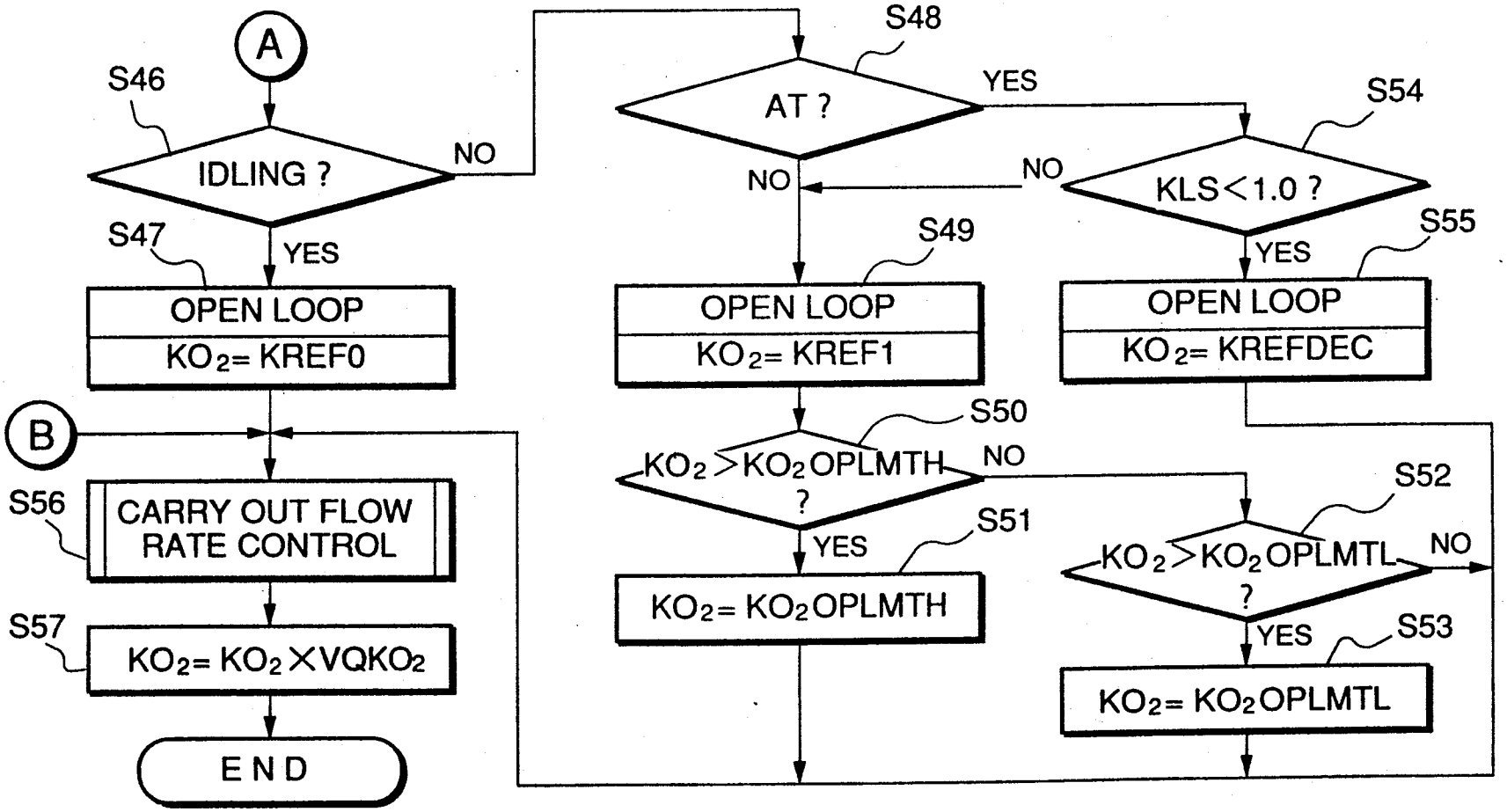
FIG. 13 is a flowchart of a program for calculating the air-fuel ratio correction coefficient $KO_2$.

FIGS. 12 and 13 show a program of calculating the air-fuel ratio correction coefficient $KO_2$, in which the $KO_2$ value is modified by the vapor flow rate-dependent correction coefficient $VQKO_2$.

At a step S30, the coefficient $KO_2$ is calculated back to the value before its modification by the vapor flow rate-dependent correction coefficient $VQKO_2$, by the use of the following equation:

$$KO_2 = KO_2 / VQKO_2 \quad (8)$$

At the next step S31, it is determined whether or not a flag n02 is equal to 1. The flag n02 indicates whether or not the $O_2$ sensor has been determined to be activated, and is set to a value of 0 when the system is initialized.

If the answer to the question of the step S31 is affirmative (YES), i.e. if n02=1, which means that the $O_2$ sensor 12 has been determined to be activated, it is determined at a step S32 whether or not a predetermined time period tX has elapsed after the $O_2$ sensor became activated. If the answer to this question is affirmative (YES), a reference coolant temperature value TWO2 is calculated at a step S33 according to the intake air temperature TA and the vehicle velocity VH detected by respective sensors, not shown. Then, it is determined at a step S34 whether or not the engine coolant temperature detected is higher than the calculated reference coolant temperature value TWO2. If the answer to this question is affirmative (YES), i.e. if TW>TWO2, which means that the engine has been warmed up, it is determined at a step S35 whether or not a flag FLGWOT is equal to 1. The flag FLGWOT is set to a value of 1 when it is determined by a routine, not shown, that the engine 1 is in a predetermined high load region in which the fuel supply amount should be increased.

If the answer to the step S35 is negative (NO), i.e. if the engine 1 is not in the high load region, it is determined at a step S36 whether or not the engine rotational speed NE is higher than a predetermined value NHOP on the high rotational speed side. If the answer to this question is negative (NO), it is determined at a step S37 whether or not the engine rotational speed NE is higher than a predetermined value NLOP on the low rotational speed side. If the answer to this question is affirmative (YES), i.e. if NLOP<NE≦NHLOP, it is determined at a step S38 whether or not a leaning coefficient KLS assumes a value smaller than 1.0, i.e. whether the engine is in a predetermined decelerating region. If the answer to this question is negative (NO), it is determined at a step S39 whether or not fuel cut, i.e. cutting-off of fuel supply to the engine 1 is being carried out. If the answer to this question is negative (NO), it is determined that the engine 1 is in the feedback control region, and the program proceeds to a step S40, where the correction coefficient $KO_2$ is calculated according to the output from the $O_2$ sensor 12, and at the same time an average value KREF of the correction coefficient $KO_2$ is calculated by a KREF-calculating subroutine, not shown, followed by the program proceeding to a step S56 shown in FIG. 13.

If the answer to the question of the step S37 is negative (NO), i.e. if NE≦NLOP, which means that the engine 1 is in a predetermined low engine rotational region, if the answer to the question of the step S38 is affirmative (YES), i.e. if the engine 1 is in the predetermined decelerating region, or if the answer to the question of the step S39 is affirmative (YES), i.e. if fuel cut is being carried out, the program proceeds to a step S41. At the step S41, it is determined whether or not the present loop has been continuously carried out over a predetermined time period tD. If the answer to this question is negative (NO), the correction coefficient $KO_2$ is held at the immediately preceding value assumed before entering the present loop at a step S42, whereas if the answer is affirmative (YES), the correction coefficient $KO_2$ is set to a value of 1.0 at a step S43 to carry out the open loop control, followed by the program proceeding to the step S56 shown in FIG. 13. In short, if the engine 1 has shifted from the feedback control region to one of the open loop control regions due to fulfillment of a corresponding one of the conditions determined at the steps S37 to S39, the correction coefficient $KO_2$ is held at the immediately preceding value calculated during the feedback control before shifting to the open loop control region until the predetermined time period tD elapses, whereas it is set to 1.0 after the predetermined time period tD has elapsed.

If the answer to the question of the step S34 is negative (NO), i.e. if the engine 1 has not been warmed up, if the answer to the question of the step S35 is affirmative (YES), i.e. if the engine 1 is not in the predetermined high load region, or if the answer to the question of the step S36 is affirmative (YES), i.e. if the engine 1 is in the predetermined high rotational speed region, the program proceeds to the step S43 to carry out the open loop control, followed by the program proceeding to the step S56 in FIG. 13.

If the answer to the question of the step S31 is negative (NO), i.e. if it is determined that the $O_2$ sensor 12 has not been activated, or if the answer to the question of the step S32 is negative (NO), i.e. if the predetermined time period tX has not elapsed after activation of the $O_2$ sensor 12, steps S44 and S45 are carried out in the same manner as the steps S33 and S34, and if the answer to the question of the step S45 is negative (NO), i.e. if the engine 1 has not been warmed up, the step S43 is carried out, followed by the program proceeding to the step S56 in FIG. 13.

If the answer to the question of the step S45 is affirmative (YES), i.e. if the engine 1 has been warmed up, the program proceeds to a step S46 in FIG. 13, where it is determined whether or not the engine 1 is in an idling region. This determination is carried out by determining whether or not the engine rotational speed NE is equal to or lower than a predetermined value and at the same time the throttle valve opening $\theta$TH is equal to or smaller than a predetermined value. If the answer to this question is affirmative (YES), i.e. if the engine is in the idling region, the correction coefficient $KO_2$ is set to an average value KREFO thereof suitable for the idling region (hereinafter referred to as "the idling region average value") at a step S47 to carry out the open loop control, followed by the program proceeding to the step S56.

If the answer to the question of the step S46 is negative (NO), i.e. if the engine 1 is in any region other than the idling region (hereinafter referred to as "the off-idle region"), it is determined at a step S48 whether or not the vehicle on which the engine 1 is installed is an AT type, i.e. a vehicle equipped with an automatic transmission. If the vehicle is not an AT type, the program proceeds to a step S49, where the correction coefficient $KO_2$ is set to an average value KREF1 thereof for the off-idle region (hereinafter referred to as "the off-idle average value).

Next, at steps S50 et seq., limit checking of the correction coefficient $KO_2$ set at the step S49 is carried out. More specifically, it is determined at a step S50 whether or not the correction coefficient $KO_2$ larger than a upper limit value KO2OPLMTH. If the answer to this question is affirmative (YES), the correction coefficient $KO_2$ is set to the upper limit value KO2PLMH at a step S51, followed by the program proceeding to the step S56, whereas if the answer is negative (NO), it is determined at a step S52 whether or not the correction coefficient $KO_2$ is smaller than a lower limit value KO2OPLMTL. If the answer to this question is affirmative (YES), the correction coefficient $KO_2$ is set to the lower limit value KO2OPLMTL at a step S53, followed by the program proceeding to the step S56, whereas if the answer is negative (NO), the program jumps to the step S56.

If the answer to the question of the step S48 is affirmative (YES), i.e. if the vehicle is an AT type, it is determined at a step S54 whether or not the leaning coefficient KLS is smaller than 1.0. If the answer to this question is negative (NO), i.e. if the engine is not in the predetermined decelerating region, the steps S49 et seq. are carried out, whereas if the answer is affirmative (YES), i.e. if the engine 1 is in the predetermined decelerating region, the correction coefficient $KO_2$ is set to an average value KREFDEC thereof for the decelerating region (hereinafter referred to as "the decelerating region average value) at a step S55 to carry out the open loop control, followed by the program proceeding to the step S56.

Figure 14:
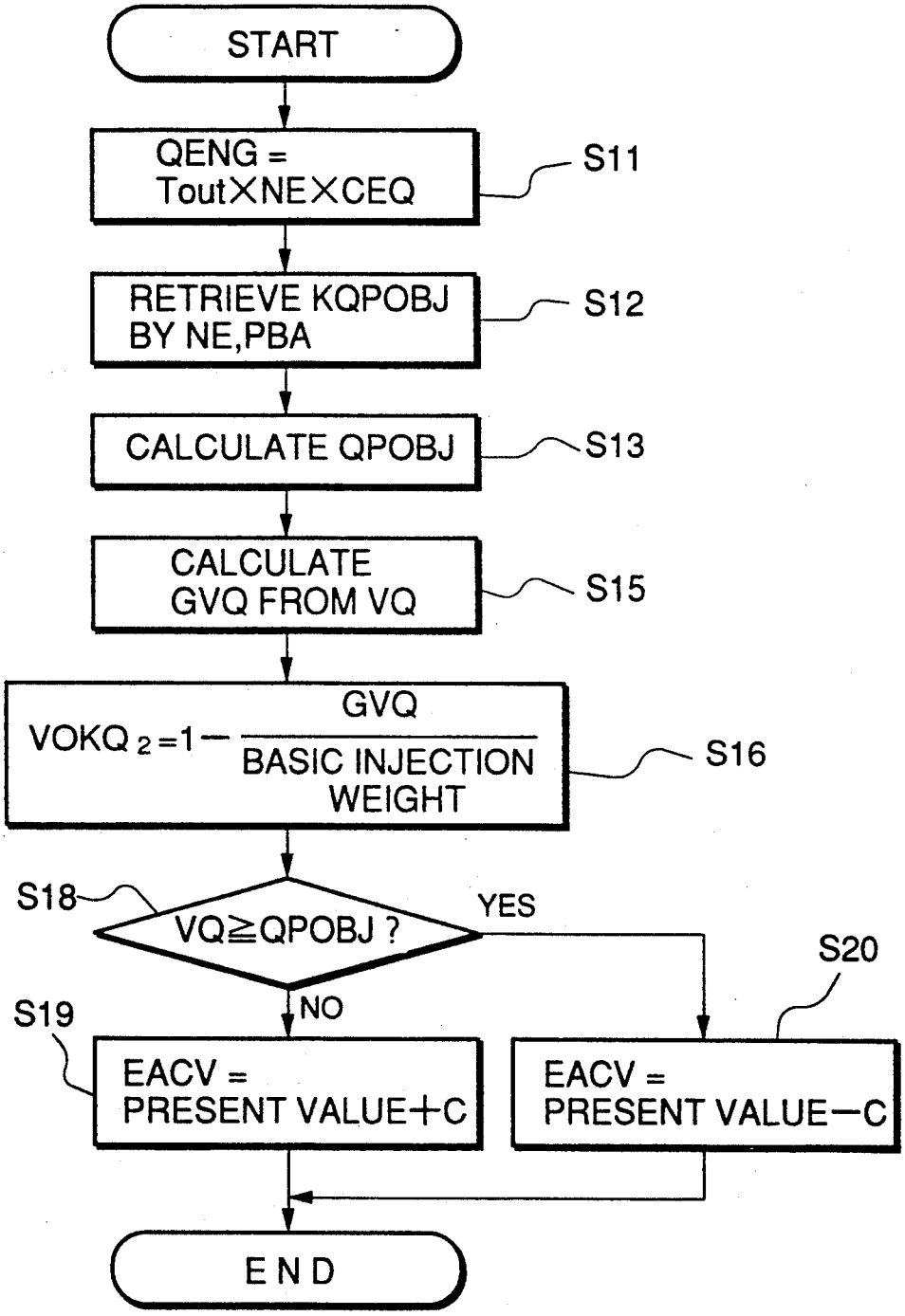
FIG. 14 is a flowchart of a program for controlling the purge control valve opening in response to the evaporative fuel flow rate VQ and calculating a vapor flow rate correction coefficient $VQKO_2$.

At the step S56, the vapor flow rate control is carried out according to a routine therefor shown in FIG. 14. This routine is intended to carry out substantially the same processing as the FIG. 11 routine except modification of the correction coefficient $KO_2$. The flowchart of the FIG. 14 routine is therefore distinguished from that of the FIG. 11 routine in that the steps S14 and S17 of the latter are omitted in the former. That is, at the step S56, the vapor flow rate control and the calculation of the vapor flow rate-dependent correction coefficient $VQKO_2$ are carried out in response to the actual vapor flow rate VQ.

Referring back to FIG. 13, at a step S57 following the step S56, the correction coefficient $KO_2$ is modified by multiplying the $KO_2$ value calculated at the steps S31 to S55 by the correction coefficient $VQKO_2$.

According to the program shown in FIGS. 12 and 13, the control of the purge control valve 16 and the modification of the air-fuel ratio correction coefficient $KO_2$ responsive to the actual vapor flow rate VQ are effected similarly to the FIG. 11 program, which enables to prevent degraded responsiveness of the feedback control.

Figure 15:
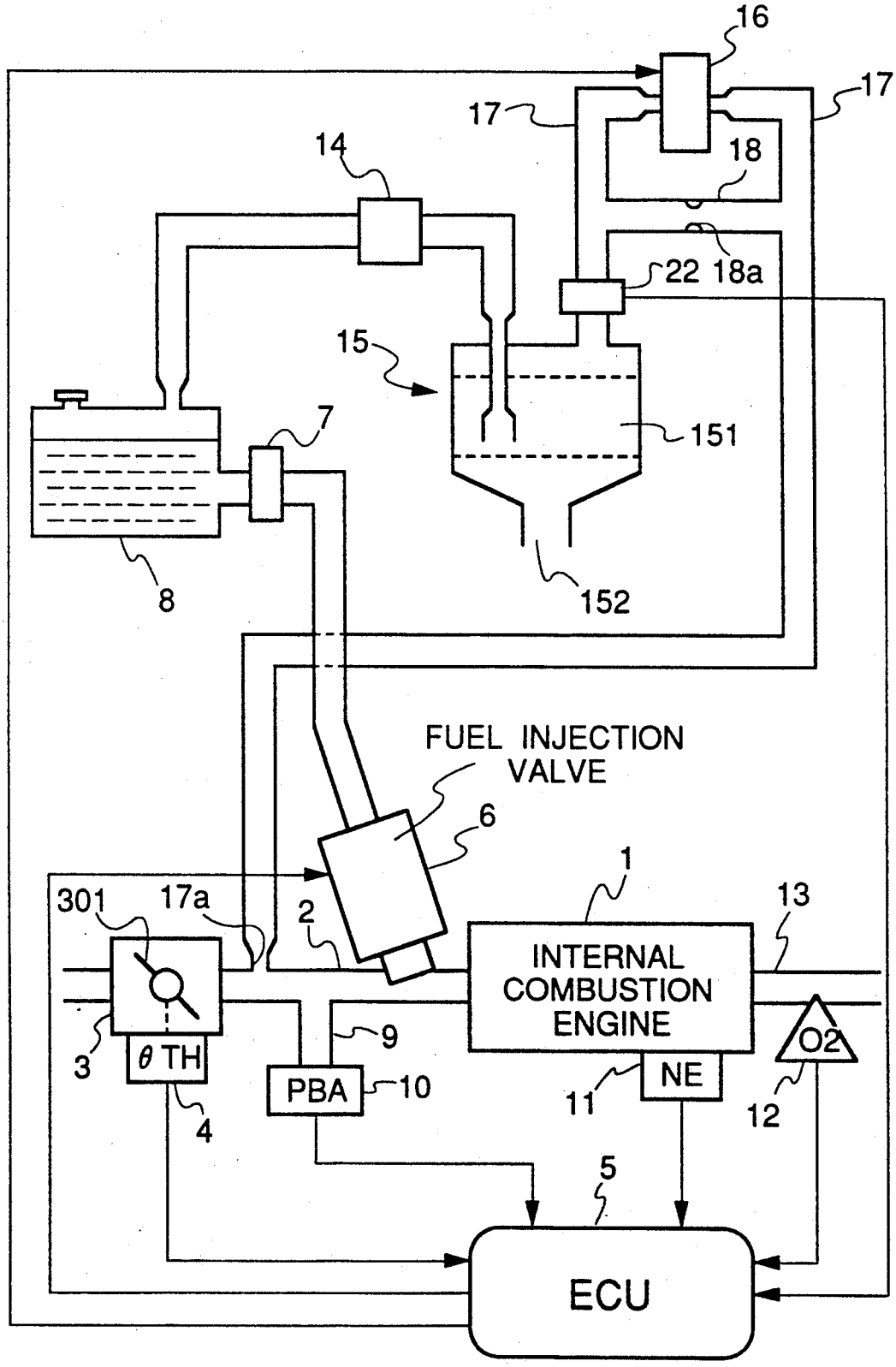
FIG. 15 is a block diagram showing the arrangement of a second embodiment of the invention.

FIG. 15 shows the whole arrangement of a fuel supply control system including a second embodiment of the invention. According to this embodiment, a bypass passage 18 bypassing the purge control valve 16 is provided in the purging passage 17, which bypass passage is formed with a low flow rate jet restriction 18*a*. Except for this point, this fuel supply control system has the same construction as that of the FIG. 1 fuel supply control system.

Figure 16:
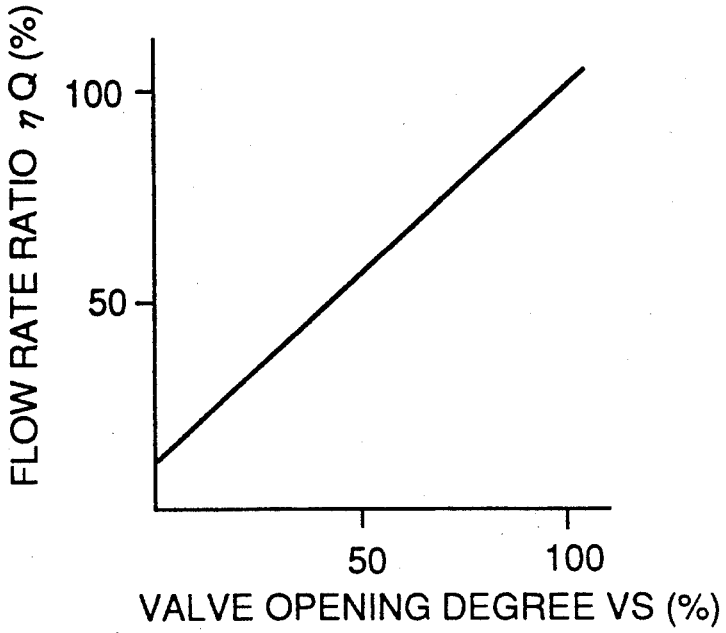
FIG. 16 is a graph showing a flow rate characteristic of flow through a variation of the purging passage 17 appearing in FIG. 15.

By virtue of the provision of the bypass passage 18, the purging flow rate is not reduced to zero even if the purge control valve 16 is fully closed. Therefore, the purging passage 17 of this embodiment has a flow rate characteristic as shown in FIG. 16, which contributes to reducing variation in the flow rate in a low flow rate region where the opening of the purge control valve 16 is small.

Figure 17:
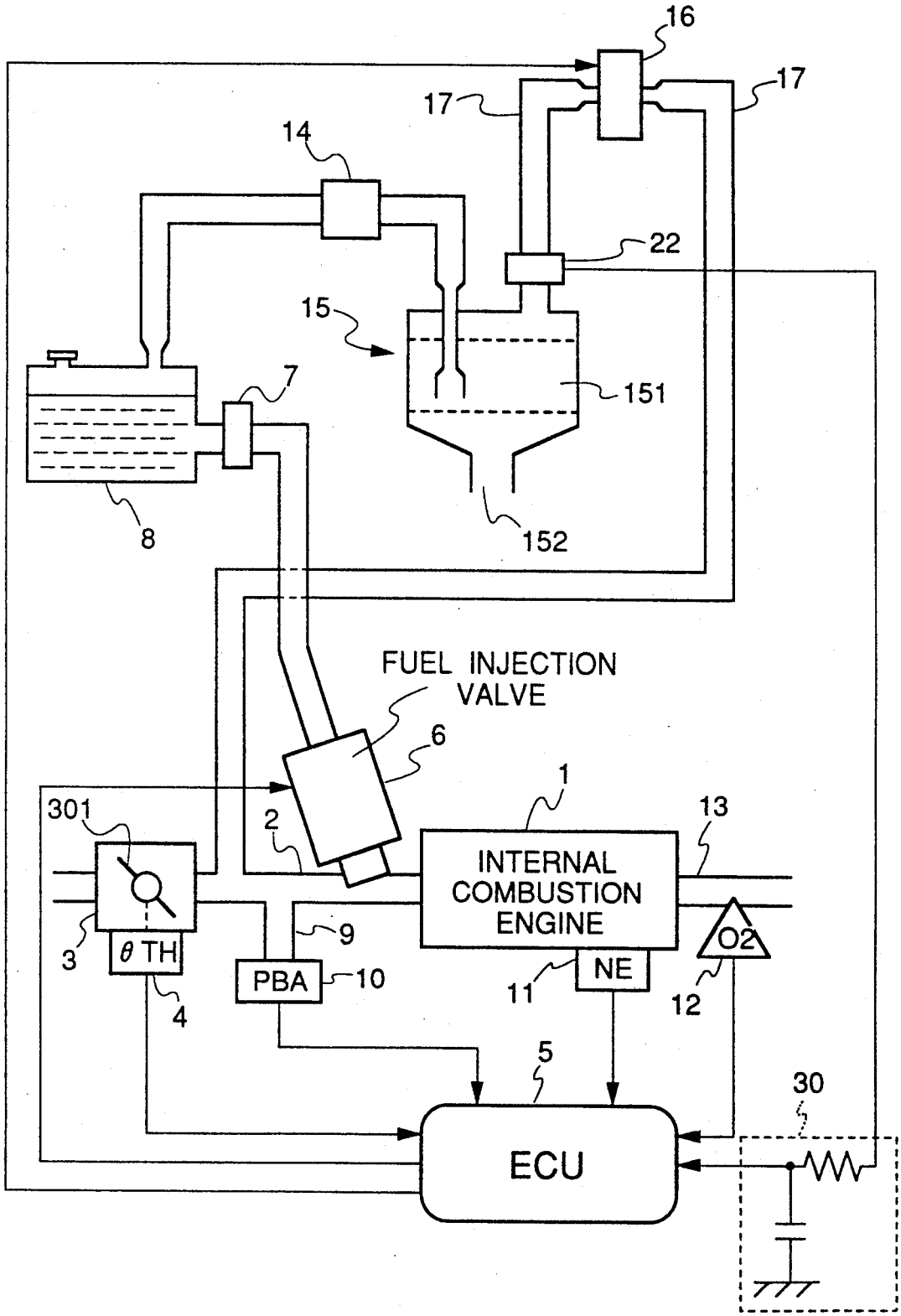
FIG. 17 is a block diagram showing the arrangement of a third embodiment of the invention.

FIG. 17 shows the whole arrangement of a fuel supply control system including a third embodiment of the invention.

In this embodiment, the purge control valve 16 is not a linear type, but a duty control type which is adapted to have the ratio of the valve opening period to the valve closing period varied so as to linearly change the flow rate. The on/off duty ratio Duty of the duty control type purge control valve 16 is controlled to control the purging flow rate. Further, the purging passage 17 communicates with the intake pipe 2 at a location downstream of the throttle body 3. A noise filter 30, which is comprised e.g. of a resistance and a capacitor, is interposed between the hot-wire type mass flowmeter 22 and the ECU 5. Except for these points, the third embodiment has the same arrangement as the first embodiment.

In this embodiment, the term "PB flow rate" means a flow rate of a mixture of evaporative fuel and air, which is calculated based on the on/off duty ratio (hereinafter referred to as "the duty ratio") of the purge control valve and the intake pipe absolute pressure PBA. The PB flow rate is in a predetermined relationship with the purging flow rate TQ, which is similar to the relationship between the PC flow rate and the purging flow rate TQ, mentioned before. Therefore, it is also possible to calculate the vapor flow rate VQ, the purging flow rate TQ, and the vapor concentration $\beta$, based on the PB flow rate and the output value QH of the hot-wire type mass flowmeter.

Figure 18:
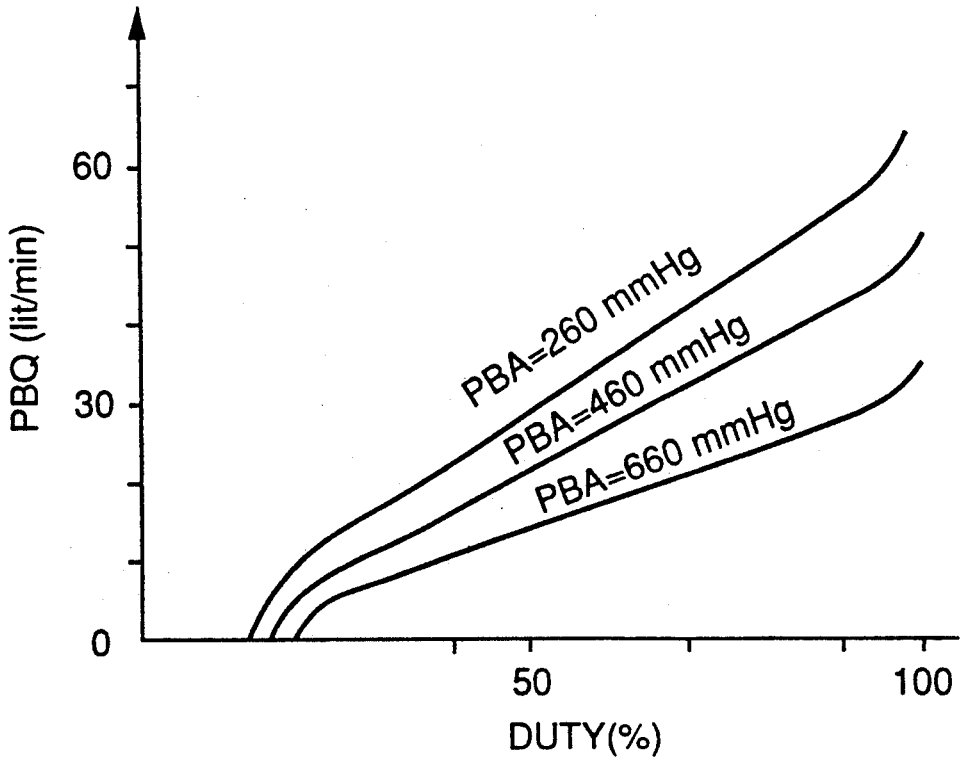
FIG. 18 is a graph showing the relationship between a duty ratio Duty for on/off control of the purge control valve, the intake pipe absolute pressure PBA, and a PB flow rate PBQ.

FIG. 18 shows the relationship between the duty ratio Duty (%) and the PB flow rate PBQ (l/min) which holds when the vapor concentration $\beta$ is 0% (i.e. the air concentration is 100%). In the figure, the curves correspond, respectively, to different values of the intake pipe absolute pressure PBA, i.e. 260 mmHg, 460 mmHg, and 660 mmHg. By the use of the relationship of FIG. 18 between the duty ratio Duty (%) the intake pipe absolute pressure PBA, and the basic PB flow rate PBQ, which is dependent on the vapor concentration, the basic PB flow rate PBQ is calculated according to the duty ratio Duty and the intake pipe absolute pressure PBA.

The PB flow rate PBQ has the same characteristic as the PC flow rate PCQ1 which can be illustrated in graphs similar to the graphs of FIGS. 4 and 5, in which PBQ replaces PCQ1. Therefore, the vapor concentration $\beta$, the vapor flow rate VQ, and the purging flow rate TQ can be calculated based on the PB flow rate PBQ and the output value QH of the hot-wire type mass flow meter.

Figure 19:
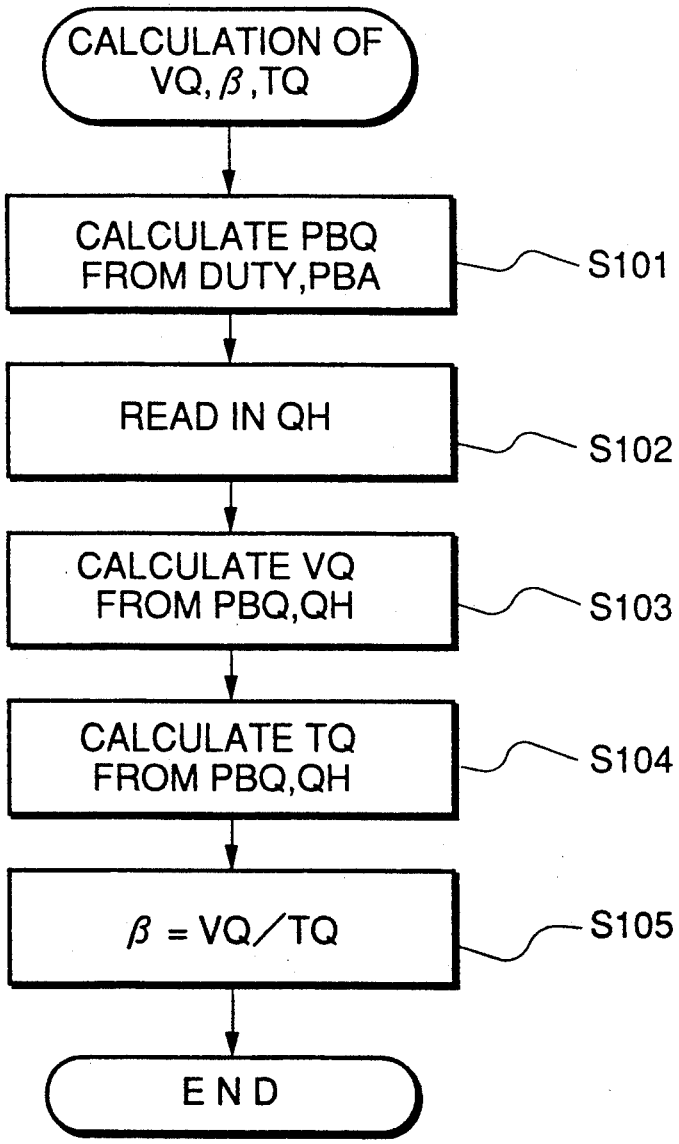
FIG. 19 is a flowchart of a program for calculating the evaporative fuel flow rate VQ, the evaporative fuel concentration $\beta$, and a flow rate TQ of a mixture of evaporative fuel and air.

FIG. 19 shows a program for calculating the vapor concentration $\beta$, the vapor flow rate VQ, and the purging flow rate TQ.

First, at a step S101, the PB flow rate PBQ is calculated according to the duty ratio Duty and the intake pipe absolute pressure PBA. The PB flow rate PBQ is read from a PBQ table, e.g. as shown in FIG. 20, in which predetermined PBQ values PBQ(0,0)~PBQ(15,15) are set corresponding to predetermined duty ratio values Duty0~Duty15 and predetermined intake pipe absolute pressure PBA values PBA0 to PBA15 based on the relationship exemplified in FIG. 18, and calculated by interpolation if required.

At steps S102 to S105, in a manner similar to the steps S4 to S7 in FIG. 6 described hereinbefore, the QH value is read in, and the vapor flow rate VQ, the purging flow rate TQ, and the vapor concentration $\beta$ are calculated. That is, in the present embodiment, the VQ value and the TQ value are read from a VQ map and a TQ map in which predetermined VQ values and predetermined TQ values are set corresponding to predetermined PBQ values and predetermined QH values, respectively, and calculated by interpolation if required. Then the vapor concentration $\beta$ is calculated from $\beta = VQ/TQ$.

Figure 21:
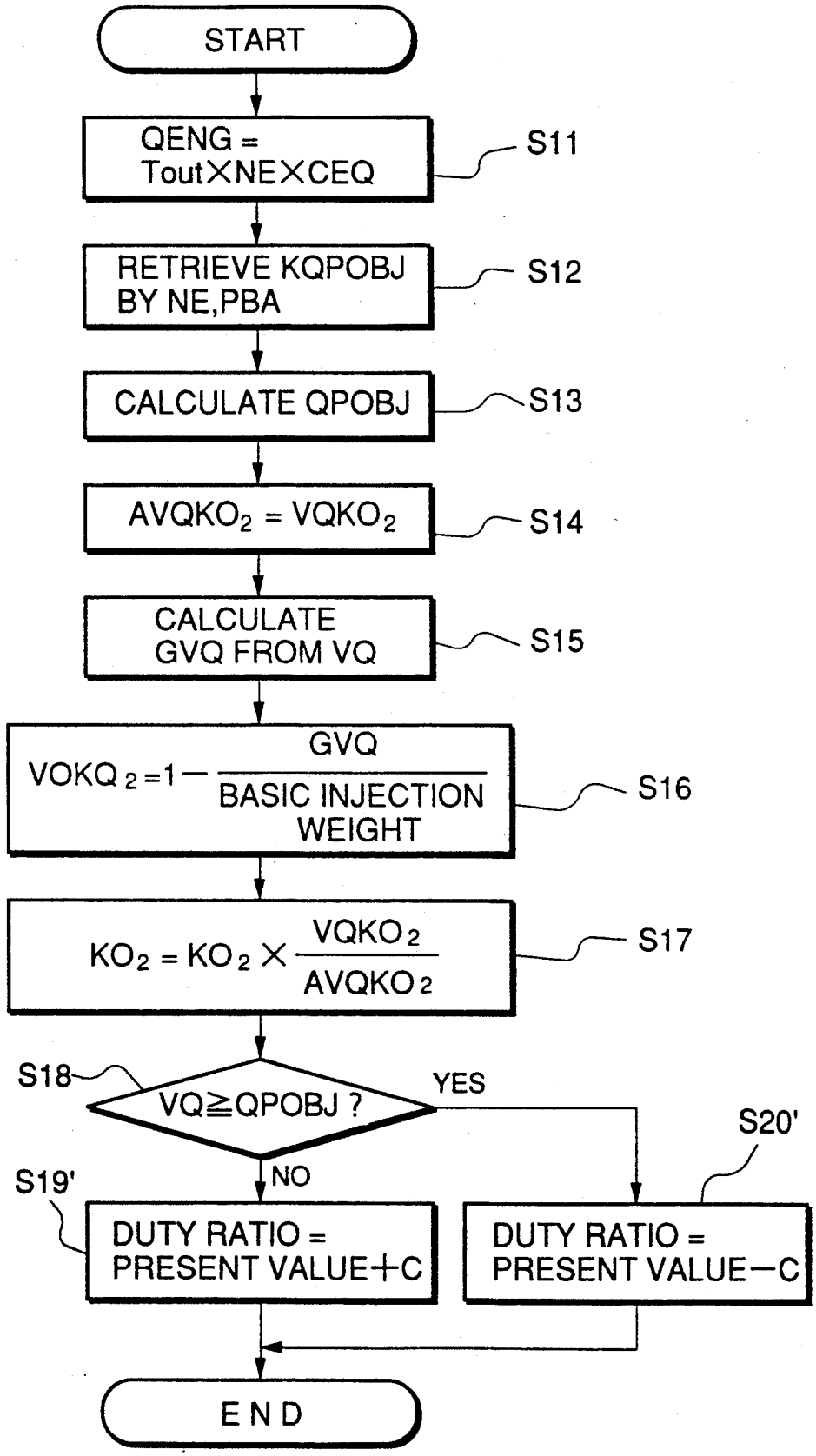
FIG. 21 is a flowchart of a program for controlling the duty ratio Duty and the fuel supply amount in response to the evaporative fuel flow rate VQ.

FIG. 21 shows a program for calculating the vapor flow rate-dependent correction coefficient $VQKO_2$ and a corrected value of the duty ratio Duty of the purge control valve 16. This figure is distinguished from FIG. 11 only in that steps S19' and S20' of the former are different from the corresponding steps S19 and S20 of the latter. If $VQ \geqq QPOBJ$, the duty ratio Duty of the purge control valve 16 is increased by a predetermined amount (C') at the step S19', whereas if $VQ < QPOBJ$, the duty ratio Duty is decreased by the predetermined amount (C') at the step S19', to thereby calculate the corrected duty ratio (control amount) in respective cases.

This embodiment, in which the purging passage 17 is communicated with the intake pipe 2 at the location downstream of the throttle valve 301, and the vapor flow rate VQ, etc. are calculated based on the duty ratio Duty and the intake pipe absolute pressure PBA, has the following advantages:

If the purging passage 17 is communicated with the interior of the throttle body 3 via the PC port **17*a*** as in the first and second embodiments, there can occur errors in calculation of the vapor flow rate VQ, etc. which are appreciable depending upon variation in the location of the PC port and the diameter of same. According to the present embodiment, such calculation errors can be reduced to thereby enable to accurately calculate the vapor flow rate VQ, etc. at a low cost.

More specifically, if the on/off control type is used for the purge control valve 16 in the first or second embodiment, the following errors (in percentage relative to each calculated value) are expected in the results of calculation: 1) approx.±8% due to variation in the diameter of the PC port, 2) approx.±8% due to phasic errors in the throttle valve opening, 3) approx.±8% due to errors in mounting the throttle valve, and 4) approx.±5% due to errors in the controlled flow through the purge control valve, which amount to a total error of approx.±29% at the maximum. In contrast, according to the present embodiment, only the following errors are expected: 1) approx.±2% due to variation in the output from the intake pipe absolute pressure sensor, and 2) approx.±5% due to errors in the flow rate controlled through the purge control valve. Therefore, it is possible to reduce the total error to the maximum value of approx.±7%.

Further, although as the purge control valve 16, a single linear or on/off control type is used in the above embodiments, this is not limitative, but two or more control valves may be used to effect stepwise control of the flow rate by selectively operating the control valves.

What is claimed is:

1. In an evaporative fuel-purging control system for an internal combustion engine having a fuel tank and an intake passage, said evaporative fuel-purging control system including a canister for adsorbing evaporative fuel generated from said fuel tank, a purging passage connecting between said canister and said intake passage for purging a gaseous mixture containing said evaporative fuel therethrough into said intake passage, and a purge control valve arranged across said purging passage for controlling the flow rate of said evaporative fuel supplied to said intake passage, the improvement comprising:

a mass flowmeter arranged across said purging passage for outputting an output value indicative of a flow rate of said gaseous mixture being purged through said purging passage;

purging flow rate-calculating means for calculating a value of the flow rate of said gaseous mixture flowing through said purging passage, based on a plurality of operating parameters of said engine;

actual evaporative fuel flow rate-calculating means for calculating an actual flow rate of said evaporative fuel flowing through said purging passage, based on said output value from said mass flowmeter and the calculated value of the flow rate of said gaseous mixture obtained by said purging flow rate-calculating means;

desired evaporative fuel flow rate-setting means responsive to operating conditions of said engine for setting a desired flow rate of said evaporative fuel; and purge control means for comparing said desired flow rate of said evaporative fuel with said actual flow rate of said evaporative fuel, and controlling an opening of said purge control valve, based on results of the comparison.

2. An evaporative fuel-purging control system according to claim 1, wherein said purge control valve is a linear control type.

3. An evaporative fuel-purging control system according to claim 2, wherein said engine includes a throttle valve having a valve element and arranged in said intake passage, and said purging flow rate-calculating means calculates said flow rate of said mixture by multiplying a basic flow rate determined by an opening of said throttle valve and pressure within said intake passage by a flow rate ratio dependent on the opening of said purge control valve.

4. An evaporative fuel-purging control system according to claim 3, wherein said purging passage has a port opening into said intake passage, said port being located such that when said throttle valve is open, said port is downstream of said valve element of said throttle valve, whereas when said throttle valve is closed, said port is upstream of said valve element of said throttle valve.

5. An evaporative fuel-purging control system according to any one of claims 1 to 4 wherein said purging passage further includes a bypass passage bypassing said purge control valve, said bypass passage being provided with a low flow rate jet restriction.

6. An evaporative fuel-purging control system according to claim 1, wherein said purge control valve is a duty control type.

7. An evaporative fuel-purging control system according to claim 6, wherein said purging flow rate-calculating means calculates said flow rate of said gaseous mixture, based on a duty ratio of said purge control valve and pressure within said intake passage.

8. An evaporative fuel-purging control system according to claim 7, wherein said engine includes a throttle valve arranged in said intake passage, and said purging passage has a port opening into said intake passage at a location downstream of said throttle valve.

9. In an air-fuel ratio control system for an internal combustion engine having a fuel tank and an intake passage, said air-fuel ratio control system including a canister for adsorbing evaporative fuel generated from said fuel tank, a purging passage connecting between said canister and said intake passage for purging a gaseous mixture containing said evaporative fuel therethrough into said intake passage, and a purge control valve arranged across said purging passage for controlling the flow rate of said evaporative fuel supplied to said intake passage, the improvement comprising:

a mass flowmeter arranged across said purging passage for outputting an output value indicative of a flow rate of said gaseous mixture being purged through said purging passage;

purging flow rate-calculating means for calculating a value of the flow rate of said gaseous mixture flowing through said purging passage, based on a plurality of operating parameters of said engine;

actual evaporative fuel flow rate-calculating means for calculating an actual flow rate of said evaporative fuel flowing through said purging passage based on said output value from said mass flowmeter and the calculated value of the flow rate of said gaseous mixture obtained by said purging flow rate-calculating means; and correcting means for correcting a basic amount of fuel supplied to said engine based on the calculated actual flow rate of said evaporative fuel.

10. An air-fuel ratio control system according to claim 9, wherein said correcting means calculates a weight per unit time of said evaporative fuel supplied into said intake passage, based on the calculated actual flow rate of said evaporative fuel, and corrects said basic amount of fuel supplied to said engine by the use of an evaporative fuel-dependent correction coefficient calculated based on a ratio of the calculated weight per unit time of said evaporative fuel to a weight per unit time of fuel supplied to said engine by injection.

11. An air-fuel ratio control system according to claim 10, wherein said correcting means corrects said basic amount of fuel supplied to said engine by an air-fuel ratio correction coefficient for multiplying said basic amount of fuel thereby, said air-fuel ratio correction coefficient being modified by multiplying said air-fuel ratio correction coefficient by a ratio of a present value of said evaporative fuel-dependent correction to an immediately preceding value thereof.

12. An air-fuel ratio control system according to any one of claims 9 to 11, wherein said engine includes a throttle valve having a valve element and arranged in said intake passage, and said purge control valve is a linear control type, said purging flow rate-calculating means calculating said flow rate of said gaseous mixture by multiplying a basic flow rate determined by an opening of said throttle valve and pressure within said intake passage by a flow rate ratio dependent on an opening of said purge control valve.

13. An air-fuel ratio control system according to claim 12, wherein said purging passage has a port opening into said intake passage, said port being located such that when said throttle valve is open, said port is downstream of said valve element of said throttle valve, whereas when said throttle valve is closed, said port is upstream of said valve element of said throttle valve.

14. An air-fuel ratio control system according to any one of claims 9 to 11 wherein said purge control valve is a duty control type, and said purging flow rate-calculating means calculates said flow rate of said gaseous mixture, based on a duty ratio of said purge control valve and pressure within said intake passage.

15. An air-fuel ratio control system according to claim 14, wherein said engine includes a throttle valve arranged in said intake passage, and said purging passage has a port opening into said intake passage at a location downstream of said throttle valve.

16. In an evaporative fuel flow rate-detecting system for detecting a flow rate of evaporative fuel drawn into an internal combustion engine having a fuel tank and an intake passage, said evaporative fuel flow rate-detecting system including a canister for adsorbing evaporative fuel generated from said fuel tank, a purging passage connecting between said canister and said intake passage for purging a gaseous mixture containing said evaporative fuel therethrough into said intake passage, and a purge control valve arranged across said purging passage for controlling the flow rate of said evaporative fuel supplied to said intake passage, the improvement comprising:

a mass flowmeter arranged across said purging passage for outputting an output value indicative of a flow rate of said gaseous mixture being purged through said purging passage;

purging flow rate-calculating means for calculating a value of the flow rate of said gaseous mixture flowing through said purging passage, based on a plurality of operating parameters of said engine; and actual evaporative fuel flow rate-calculating means for calculating an actual flow rate of said evaporative fuel flowing through said purging passage, based on said output value from said mass flowmeter and the calculated value of the flow rate of said gaseous mixture obtained by said purging flow rate-calculating means.

17. An evaporative fuel flow rate-detecting system according to claim 16, wherein said purge control valve is a linear control type, and said engine includes a throttle valve having a valve element and arranged in said intake passage, said purging flow rate-calculating means calculating said flow rate of said mixture by multiplying a basic flow rate determined by an opening of said throttle valve and pressure within said intake passage by a flow rate ratio dependent on the opening of said purge control valve.

18. An evaporative fuel flow rate-detecting system according to claim 17, wherein said purging passage has a port opening into said intake passage, said port being located such that when said throttle valve is open, said port is downstream of said valve element of said throttle valve, whereas when said throttle valve is closed, said port is upstream of said valve element of said throttle valve.

19. An evaporative fuel flow rate-detecting system according to claim 16, wherein said purge control valve is a duty control type, and said purging flow rate-calculating means calculates said flow rate of said gaseous mixture based on a duty ratio of said purge control valve and pressure within said intake passage.

20. An evaporative fuel flow rate-detecting system according to claim 19, wherein said engine includes a throttle valve arranged in said intake passage, and said purging passage has a port opening into said intake passage at a location downstream of said throttle valve.

21. In an evaporative fuel concentration-detecting system for an internal combustion engine having a fuel tank and an intake passage, said evaporative fuel concentration system detecting concentration of evaporative fuel in a gaseous mixture containing evaporative fuel and drawn into said engine, said evaporative fuel concentration-detecting system including a canister for adsorbing evaporative fuel generated from said fuel tank, a purging passage connecting between said canister and said intake passage for purging a gaseous mixture containing said evaporative fuel therethrough into said intake passage, and a purge control valve arranged across said purging passage for controlling the flow rate of said evaporative fuel supplied to said intake passage, the improvement comprising:

a mass flowmeter arranged across said purging passage for outputting an output value indicative of a flow rate of said gaseous mixture being purged through said purging passage;

purging flow rate-calculating means for calculating a value of the flow rate of said gaseous mixture flowing through said purging passage, based on a plurality of operating parameters of said engine;

actual evaporative fuel flow rate-calculating means for calculating an actual flow rate of said evaporative fuel flowing through said purging passage, based on said output value from said mass flowmeter and the calculated value of the flow rate of said gaseous mixture obtained by said purging flow rate-calculating means;

actual purging flow rate-calculating means for calculating an actual flow rate of said gaseous mixture flowing through said purging passage based on said output value from said mass flowmeter and the calculated value of the flow rate of said gaseous mixture obtained by said purging flow rate-calculating means; and concentration-calculating means for calculating concentration of said evaporative fuel in said gaseous mixture from said actual flow rate of said gaseous mixture and said actual flow rate of said evaporative fuel.

22. An evaporative fuel concentration-detecting system according to claim 21, wherein said engine includes a throttle valve having a valve element and arranged in said intake passage, and said purge control valve is a linear control type, said purging flow rate-calculating means calculating said flow rate of said mixture by multiplying a basic flow rate determined by an opening of said throttle valve and pressure within said intake passage by a flow rate ratio dependent on an opening of said purge control valve.

23. An evaporative fuel concentration-detecting system according to claim 22, wherein said purging passage has a port opening into said intake passage, said port being located such that when said throttle valve is open, said port is downstream of said valve element of said throttle valve, whereas when said throttle valve is closed, said port is upstream of said valve element of said throttle valve.

24. An evaporative fuel concentration-detecting system according to claim 21, wherein said purge control valve is a duty control type, and said purging flow rate-calculating means calculates said flow rate of said gaseous mixture based on a duty ratio of said purge control valve and pressure within said intake passage.

25. An evaporative fuel concentration-detecting system according to claim 24, wherein said engine includes a throttle valve arranged in said intake passage, and said purging passage has a port opening into said intake passage at a location downstream of said throttle valve.

* * * * *